US005189237A

United States Patent [19]

Koguchi

[11] Patent Number: 5,189,237

[45] Date of Patent: Feb. 23, 1993

[54] APPARATUS AND METHOD FOR PERFORMING AUTO-PLAYING IN SYNCHRONISM WITH REPRODUCTION OF AUDIO DATA

[75] Inventor: Satoru Koguchi, Tokyo, Japan

[73] Assignee: Casio Computer Co., Ltd., Tokyo, Japan

[21] Appl. No.: 625,309

[22] Filed: Dec. 10, 1990

[30] Foreign Application Priority Data

Dec. 18, 1989 [JP] Japan ..... 1-327812
Dec. 18, 1989 [JP] Japan ..... 1-327813

[51] Int. Cl.[5] ..... G10H 7/00; G04B 13/00; A63H 5/00

[52] U.S. Cl. ..... 84/609

[58] Field of Search ..... 84/601-603, 84/609, 610, 645; 369/30, 70

[56] References Cited

U.S. PATENT DOCUMENTS 3,829,597 8/1974 Peterson et al. .
4,566,362 1/1986 Kikumoto ..... 84/DIG. 12 X
4,624,171 11/1986 Yuzawa et al. .
4,771,671 9/1988 Hoff, Jr. ..... 84/453 X
4,924,745 5/1990 Kimpara et al. ..... 84/609
4,995,026 2/1991 Makabe et al. ..... 84/464 R X
5,062,097 10/1991 Kumaoka ..... 84/645 X

FOREIGN PATENT DOCUMENTS 3-36585 2/1981 Japan .
62-146470 6/1987 Japan .
62-138361 9/1987 Japan .
1-199385 8/1989 Japan .

*Primary Examiner*—William M. Shoop, Jr.
*Assistant Examiner*—Jeffrey W. Donels
*Attorney, Agent, or Firm*—Frishauf, Holtz, Goodman & Woodward

[57] ABSTRACT

Audio data of a predetermined piece of music is recorded on a compact disc. A sequence of musical tone data is stored in an auto-play memory. Also stored in this auto-play memory are a time control command, an access command and a play command. An instrument controller reads out these commands to surely control the auto-playing and reproduction of data from the compact disc in synchronism.

30 Claims, 24 Drawing Sheets

| | Q1 Q2 Q3 Q4 Q5 Q6 Q7 Q8 | Q9 Q10 Q11 Q12 Q13 Q14 Q15 Q16 | |
|---|---|---|---|
| | FLAG 0 0 0 1 | 0 0 0 0 0 0 0 0 | |
| Q17 | POINT | RUNNING TIME (MINUTES) | Q32 |
| Q33 | RUNNING TIMER (SECOND) | RUNNING TIME (FRAME NO.) | Q48 |
| Q49 | 0 0 0 0 0 0 0 0 | ABSOLUTE TIME (MINUTES) | Q64 |
| Q65 | ABSOLUTE TIME (SECOND) | ABSOLUTE TIME (FRAME NO.) | Q80 |
| Q81 | ERROR DETECTION CODE (CRC CODE) | | Q96 |

FIG. 7

| | Q1 Q2 Q3 Q4 Q5 Q6 Q7 Q8 | Q9 Q10 Q11 Q12 Q13 Q14 Q15 Q16 | |
|---|---|---|---|
| | FLAG 0 0 0 1 | TRACK NO. | |
| Q17 | INDEX | RUNNING TIME (MINUTES) | Q32 |
| Q33 | RUNNING TIME (SECOND) | RUNNING TIME (FRAME NO.) | Q48 |
| Q49 | 0 0 0 0 0 0 0 0 | ABSOLUTE TIME (MINUTES) | Q64 |
| Q65 | ABSOLUTE TIME (SECOND) | ABSOLUTE TIME (FRAME NO.) | Q80 |
| Q81 | ERROR DETECTION CODE (CRC) | | Q96 |

FIG. 8

APPARATUS AND METHOD FOR PERFORMING AUTO-PLAYING IN SYNCHRONISM WITH REPRODUCTION OF AUDIO DATA

BACKGROUND OF THE INVENTION

1. Field of the Invention

The present invention relates to an auto-playing apparatus which uses a recording medium having audio data recorded thereon and memory means storing auto-play data to ensure reproduction of the audio data in synchronism with auto-playing based on the auto-play data.

2. Description of the Related Art

Auto-playing apparatuses for use in an electronic musical instrument store pitch data and tone length data, corresponding to each note of a piece of music, into a semiconductor memory according to the progress of the music, reads out these data from the memory and send them to a tone generator to automatically play the music as memorized. Such auto-playing apparatuses have been proposed and many electronic musical instruments available on the market today have such a function. The technique of an auto-playing apparatus of this type is disclosed in detail in, for example, U.S. Pat. No. 4,624,171 by Yuzawa et al.

The auto-playing apparatuses are very effective in learning how to play a music with an electronic musical instrument, because the player or user can objectively judge one's own musical performance by executing auto-playing based on key operating signals, which have been produced by the performance and stored as auto-play data in the memory.

A music generally consists of a plurality of musical parts that are to be played by a plurality of instruments. The learning effect would be further improved if a music including the entire musical parts is played on the background when playing a specific musical part. Playing a melody part while listening a music being played on the background makes it easier for one to grasp the timing for the melody part that the user should play.

The music which should be played on the background can easily be reproduced by playing an analog record, compact disk (CD) or the like by means of a player. Particularly, it is more effective to use a record or CD on which such a music has been recorded in minus-one format. The minus-one type record or CD is manufactured particularly for those who are learning how to play a piano and has a piano concerto without the piano part recorded thereon, for example. The user therefore plays his own musical instrument while reproducing the music recorded in the minus-one format.

In this case, as described above, the learning effect would be enhanced by using the aforementioned auto-playing apparatus to auto-play the music data recorded on the record, CD or the like. This auto-playing requires that the minus-one type record, CD or the like be played first and the auto-playing apparatus be started at the proper timing for the musical part which the user should play.

Unless the auto-playing apparatus is started at a predetermined timing, however, sounds reproduced from the recording medium and the auto-playing would be asynchronized, thus preventing the learning effect from further being improved.

In particular, it is very difficult through a manual operation to auto-play only a specific part of a single piece of music, not the whole piece of music, and to play a CD or the like in synchronism with the auto-playing of the specific part.

SUMMARY OF THE INVENTION

It is therefore an object of the present invention to provide an auto-playing apparatus which can surely synchronize the reproduction of a recording medium and data reproduction for auto-playing not only from the beginning of a music but also from an arbitrary part thereof.

To achieve this object, an auto-playing apparatus according to the present invention comprises a recording medium having audio data recorded thereon; reproducing means, coupled to the recording medium, for reproducing the audio data therefrom; detection means, coupled to the reproducing means, for detecting position data about a present play position on the recording medium which is being played; memory means for storing auto-play data and position data of that audio data on the recording medium which is to be reproduced in synchronism with the auto-play data, in association with the auto-play data; auto-playing means, coupled to the memory means, for reading the auto-play data from the memory means and sequentially generating corresponding tone signals to execute auto-playing; instruction means for instructing an operation concerning the auto-playing, the instruction means specifying at least a start point of a synchronized reproduction to perform data reproduction from the recording medium in synchronism with reproduction of the auto-play data; and control means, coupled to the instruction means, the auto-playing means, the detection means and the reproducing means, for executing data reproduction from the recording medium from a position corresponding to the start point of the synchronized reproduction specified by the instruction means and executing auto-playing based on the auto-play data from a position corresponding to the beginning of the synchronized reproduction.

With the above arrangement, the data reproduction from the recording medium can surely be synchronized with the reproduction of the auto-play data for an auto-playing operation even from any part. Therefore, the timing to start a melody in the whole piece of music and the image of the entire music piece can easily be grasped, producing an effect of a teaching machine which can ensure synchronized reproduction of only a specific part.

Other objects of the present invention an effects originating therefrom will be apparent from the following description of a preferred embodiment of the present invention given in conjunction with the accompanying drawings.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

FIG. 7 is a diagram illustrating the content of a control bit Q in a lead-in area on the compact disc (105);

FIG. 8 is a diagram showing the content of a control bit Q in a program area on the compact disc (105);

DETAILED DESCRIPTION OF THE PREFERRED EMBODIMENT

A preferred embodiment of the present invention will now be described referring to the accompanying drawings.

Arrangement

Figure 1:
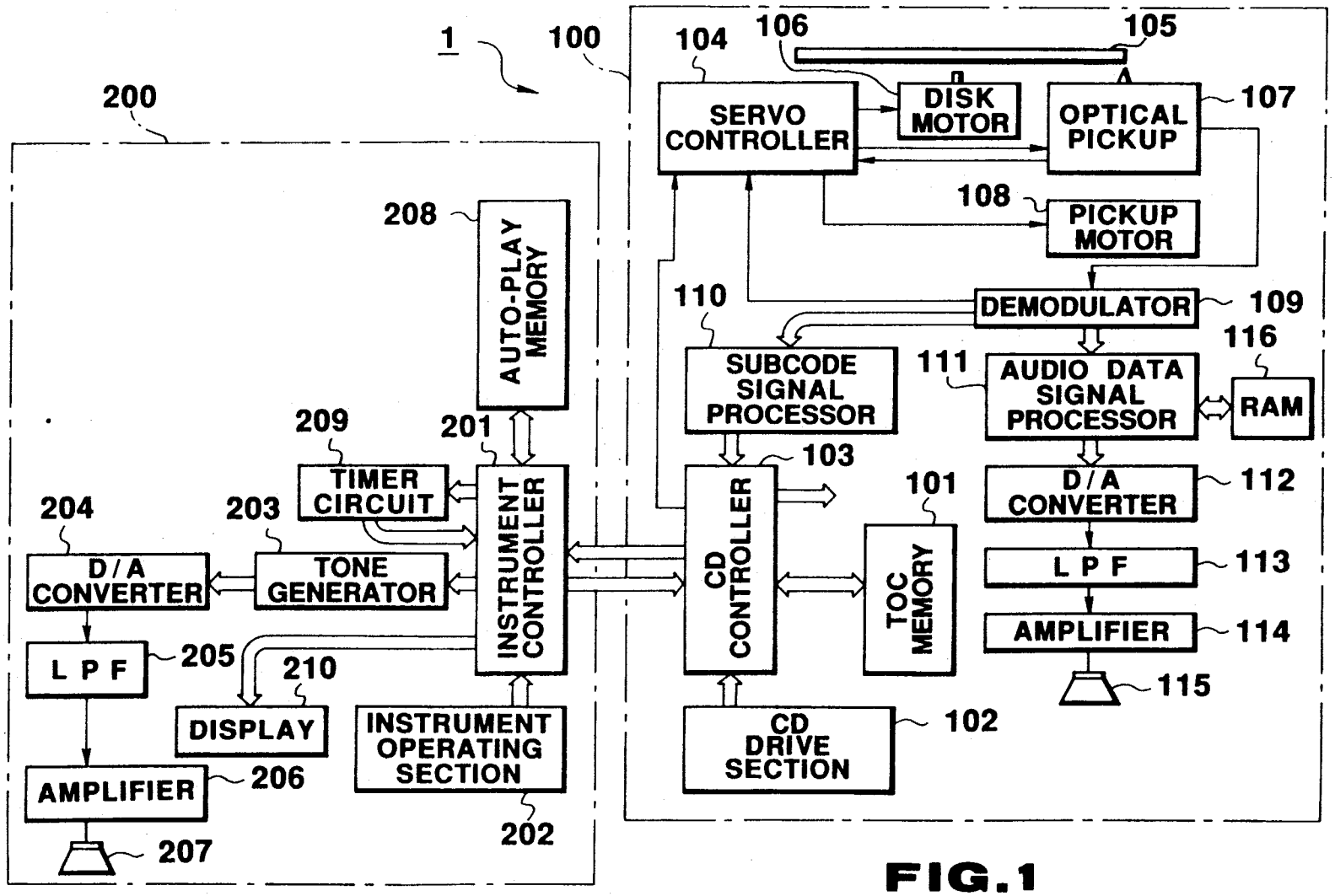
FIG. 1 is a block circuit diagram illustrating the general structure of an auto-playing apparatus (1)

FIG. 1 is a block diagram illustrating the general circuit arrangement of an auto-playing apparatus 1 according to one embodiment of the present invention, which is provided with an electronic keyboard instrument and a CD player.

Referring to FIG. 1, a block 100 surrounded by a one-dot chain line is a CD player section and a block 200 also surrounded by a one-dot chain line is an electronic keyboard instrument section.

To begin with, the block arrangement of the CD player section 100 will be described.

A CD 105 is set in a holder section (not shown) of the CD player section 100. In this embodiment, the CD player section 100 can play CDs available on the market. Particularly, suitable CDs in this embodiment are those on which music pieces are recorded in minus-one format. The minus-one type CDs are those on which audio data, such as a piano concerto excluding the piano part, for example, is recorded.

A TOC (Table of Contents) memory 101 stores TOC data of a lead-in area which is to be read out when the CD 105 is set on the CD player section 100. The TOC data will be described later.

Figure 2:
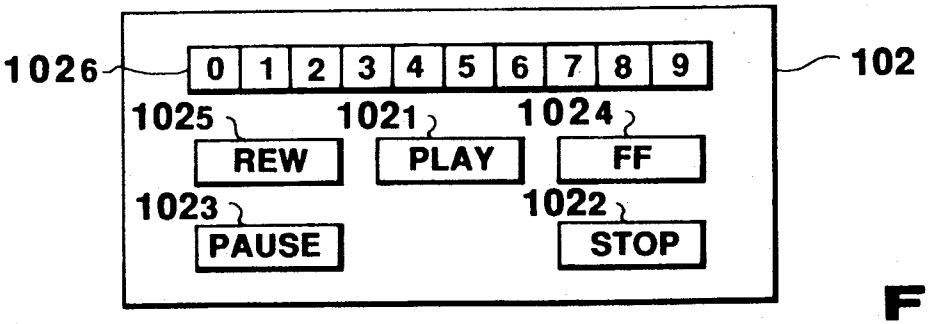
FIG. 2 is a detailed diagram of a CD drive section (102)

Reference numeral "102" denotes a CD drive section whose structure is illustrated in FIG. 2. A PLAY switch $102_1$ is used to instruct ordinary playing of a CD and CD playing in CD priority mode (to be described later). A STOP switch $102_2$ serves to instruct to stop playing a CD. A PAUSE switch $102_3$ serves to specify the point where playing a CD starts, in CD priority mode. An FF (Feed Forward) switch $10_2$ an REW (Rewind) switch $102_5$ are used to move the point where playing a CD starts, in CD priority mode. Numerical keys $102_6$, "0" to "9," are used to designate a music number to play a CD.

A CD controller 103 may be a microprocessor which performs the general control of the CD player section 100. The CD controller 103 exchanges various types of data between a subcode signal processor 110, an instrument controller 201 and the TOC memory 101. In driving the CD 105, the CD controller 103 sends a drive control signal to a servo controller 104.

The servo controller 104 controls the number of rotations of a disc motor 106 that drives the CD 105, so as to make constant the linear velocity of the tracks on the CD 105.

The servo controller 104 also executes the focus servo and tracking servo of an optical pickup 107 which irradiates a laser beam on the tracks on the CD 105. The focus servo is to detect a focus error from the status of reflection light of the laser beam and control the driving of an objective lens in the optical pickup 107 in the direction of the optical axis based on the focus error. The tracking servo is to control the laser beam from the optical pickup 10 to be accurately focused onto the center of a target track on the CD 105 by causing a pickup motor to move the optical pickup 107 in the radial direction of the CD 105 or permitting the internal lens of the pickup 107 to trace the tracks while detecting a deviation of the laser beam from the center of the target track on the CD 105.

Upheavals called pits are formed on that face of the CD 105 where the laser beam is to be irradiated, and PCM (Pulse Code Modulation) signals are recorded by the pits. The optical pickup 107 detects the presence/absence of pits based on the amount of reflected light of the irradiated laser beam and sends an electric signal corresponding to the presence/absence and the length of the pits to a demodulator 109.

The demodulator 108 detects a frame sync signal from the electric signal from the optical pickup 107 to discriminate the partition between symbol words, and subjects an EFM (Eight to Fourteen Modulation) modulated 14-bit symbol word in each frame to EFM demodulation to convert it to the original 8-bit symbol word. Of the EFM-demodulated symbol words, one containing audio data is sent to an audio data signal processor 109 and one containing a subcode is sent to the aforementioned subcode signal processor 110.

The former signal processor 109 writes input audio data into a RAM (Random Access Memory) 116, and performs an error correction based on a Reed-Solomon code as well as a de-interleaving process to restore 16-bit digital audio data frame by frame. The digital audio data is sent to a D/A (Digital to Analog) converter 112.

The D/A converter 112 converts the received digital audio data into an analog audio signal, which is sent to an amplifier 114 via an LPF (Low-pass Filter) 111 having a cutoff frequency, a half of the sampling frequency. The amplified audio signal is then released as a sound through a loudspeaker 115.

The subcode signal processor 110 performs an error detection, error correction and de-interleaving process on an 8-bit subcode to restore the subcode. Of the restored 8-bit subcode, two control bits P and Q are output to the CD controller 103; the control bits P and Q will be described in detail later.

A description will now be given of the block arrangement of the electronic keyboard instrument 200.

Figure 3:
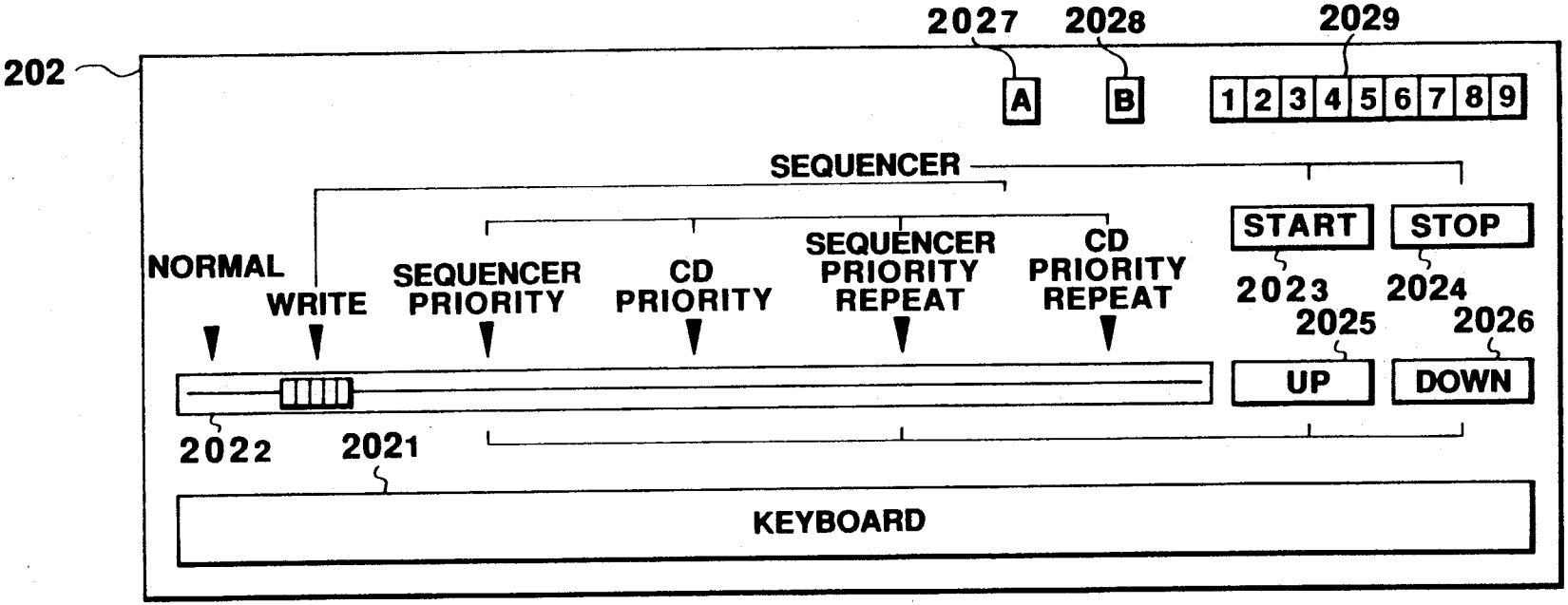
FIG. 3 is a detailed diagram of an instrument operating section (202)

As shown in FIG. 3, the instrument operating section 202 has a keyboard $202_1$, and other keys including a mode select switch $202_2$, START switch $202_3$, STOP switch $202_4$, UP switch $202_5$, DOWN switch $202_6$, A switch $202_7$, B switch $202_8$ and numeric keys $202_9$. These switches will be described later.

An instrument controller 201, which many be a microprocessor, controls an operation to write auto-play data in sequencer write mode (to be described later) and an auto-play operation in sequencer priority mode or CD priority mode (both modes will be described later) in addition to the ordinary play operation (normal mode).

A tone generator 203 produces a musical tone signal based on play data from the instrument controller 201. This musical tone signal is sent to a D/A converter 204.

The musical tone signal from the tone generator 203 is converted into an analog musical tone signal by the D/A converter 204 and an LPF (Low-pass filter) 205. The converted output is released to the outside via an amplifier 206 and a loudspeaker 207.

Figure 4:
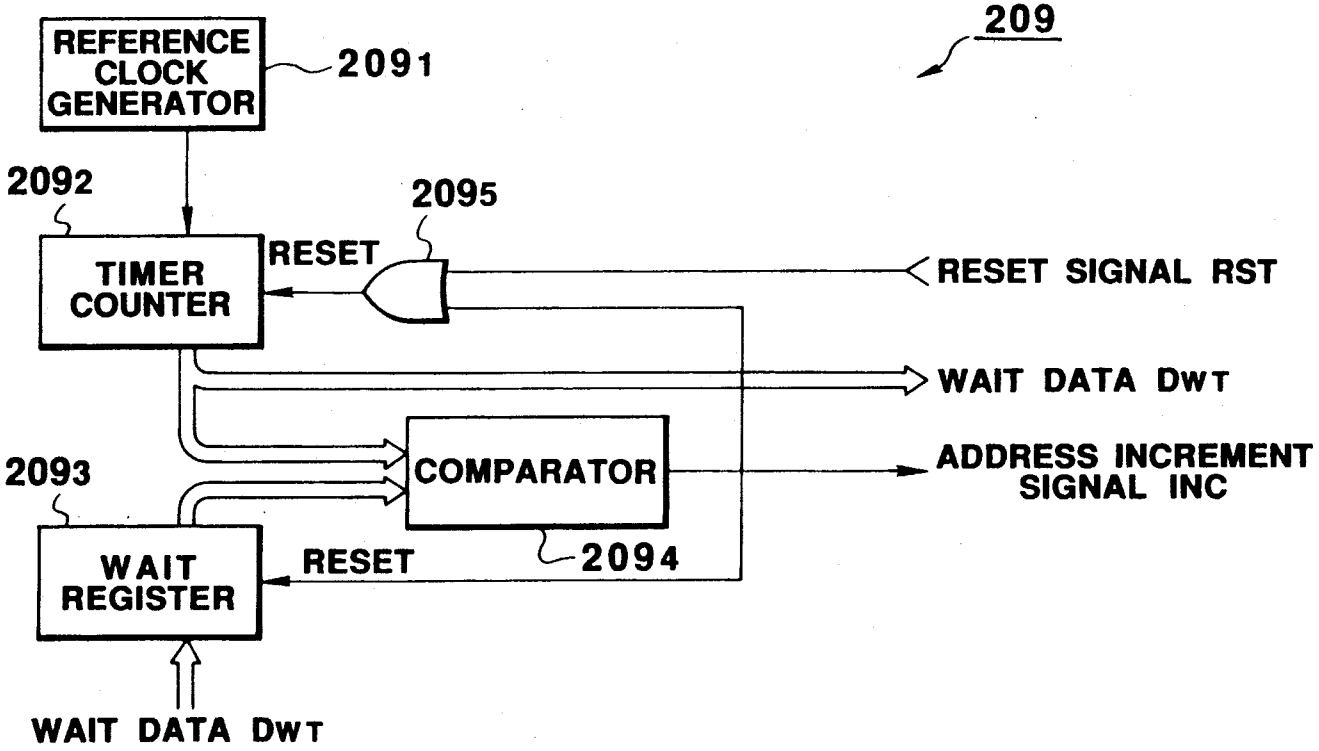
FIG. 4 is a detailed diagram of a timer circuit (209)

A timer circuit 209, which is used to control the operation associated with auto-playing, has the structure shown in FIG. 4. The structure and the operation of the timer circuit 209 will be depicted later.

Though not particularly illustrated, a display section 210, displays key data $D_{KY}$ at the point of starting auto-playing in sequencer priority mode as will be described later.

CD Recording Format

The recording format of digital data on the CD 105 will be described below.

Figure 5:
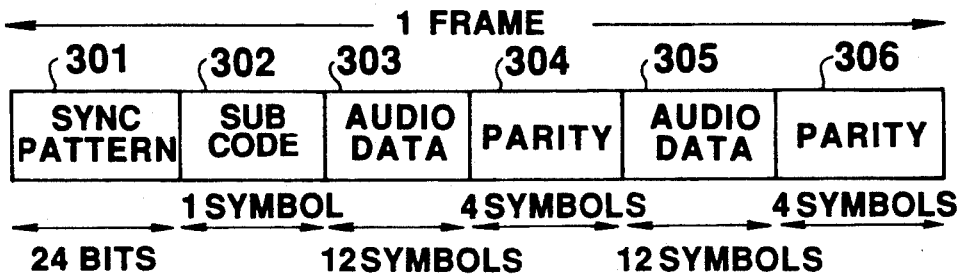
FIG. 5 is a diagram showing the frame format of a compact disc (105)

As illustrated in FIG. 5, digital data is recorded in a unit called frame in which a sync pattern (synchronize pattern) 301 consisting of 24 channel bits, a subcode 302 for one symbol, audio data 303 for 12 symbols, a parity word 304 for 4 symbols, audio data 305 for 12 symbols and a parity word 306 for 4 symbols are arranged in the named order.

In a data sequence of the above frame form, one symbol in FIG. 5 consists of 8-bit data at a stage before EFM modulation. Audio data to be recorded on the CD 105 is digital data of which each sample is sampled at 44.1 KHz and quantized by 16 bits. Therefore, each sample is expressed by two symbols. As the audio data 303 and 305 for 24 symbols in total are recorded in one frame in FIG. 5, audio data for 12 samples is recorded in one frame. The parity words 304 and 306 are called a CIRC (Cross Interleave Reed-Solomon Code).

Figure 6:
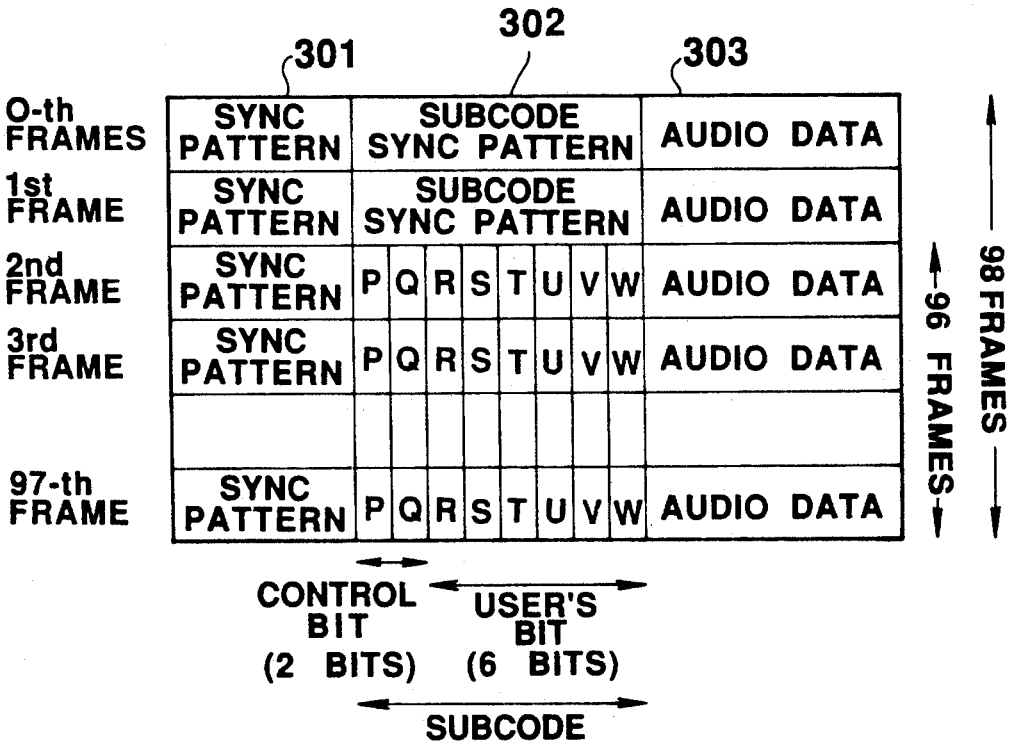
FIG. 6 is a diagram illustrating the format of a subcoding frame of the compact disc (105)

FIG. 6 shows a data format around a subcode 302. The individual bits of each 8-bit subcode 302 per frame are called P, Q, R, S, T, U, V and W, respectively. As shown in FIG. 6, 8-bit subcodes for 98 frames are grouped as one subcoding frame, and 8-bit subcodes of the 0-th frame and first frame of the 98 frames are sync patterns for the subcoding frame. The subcode signal processor 110 shown in FIG. 1 uses these subcoding-frame recognition sync patterns to recognize the subcodes P through W of each of the second to 97-th frames.

The bits R to W are user's bits which are used at the time of recording data such as a still picture. As these bits are not used in the present invention, their description will be omitted.

Figure 9:
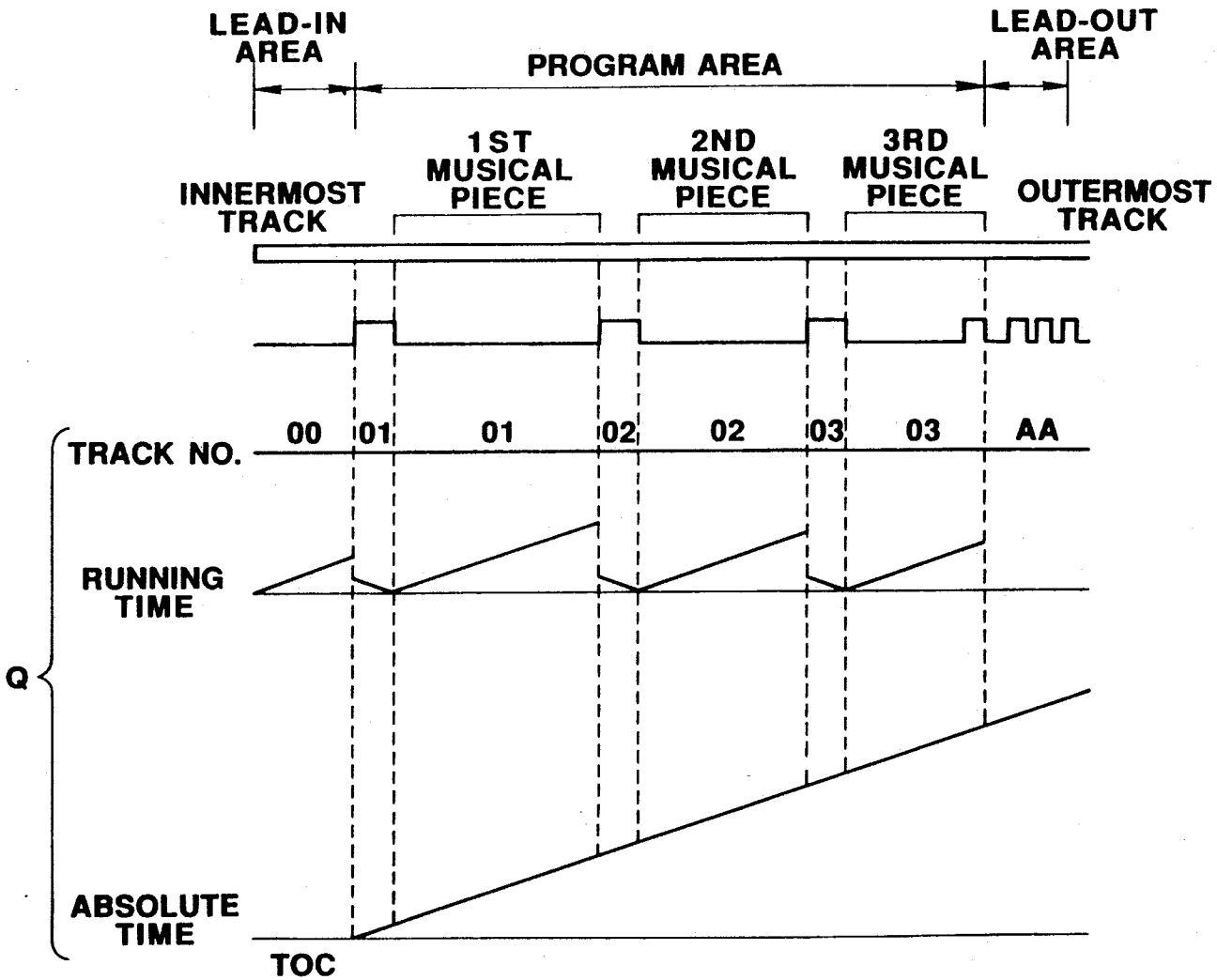
FIG. 9 is a diagram showing the recorded contents of the compact disc (105)

A description will now be given of the role of the control bits P and Q with a CD having three pieces of music recorded thereon, as shown in FIG. 9. Various types of data are recorded on the CD 105 outward from an inner track, and the innermost track region (having a diameter of 46 to 50 mm) is called a lead-in area as shown in FIG. 7. TOC information corresponding to the table of contents of the whole pieces of music recorded on a single CD are recorded in this lead-in area using the control bits Q of the subcodes in the data to be recorded in the units of frames as explained above referring to FIG. 3.

With reference to FIG. 7, the control bits Q in the TOC information for one piece of music will be described below.

Referring to FIG. 7, Q1, Q2, . . . , and Q96 respectively correspond to the control bits Q of the second frame to the 97-th frame in FIG. 6.

Q1 through Q4 are a flag which is used to discriminate the number of channels of audio data and presence/absence of emphasis. The next four bits, Q5 to Q8, are "0001" and the subsequent eight bits, Q9 to Q16, are all "0." The next eight bits, Q17 to Q24, are a point representing data of a track number (music number). The next three eight bits represent the absolute times each expressed in terms of minutes, seconds and frame number, which will be described later; these are data, which increase till the end of the lead-in area with the beginning of this area as 0, are used by the internal system and are not particularly indicated outside.

The next eight bits, Q49 to Q56, are all "0," and the subsequent three 8-bit groups represent the absolute times each expressed in terms of minutes, seconds and frame number. These three time data represent the starting point of each piece of music in a program area, which corresponds to the aforementioned point *music number), as the time elapsed from the starting point of the program area. For instance, with a CD having three pieces of music recorded thereon as shown in FIG. 9, the absolute time data from the starting points of these pieces of music are recorded for points 01, 02 and 03, respectively.

The last sixteen bits are an error detection code (CRCC: Cyclic Redundancy Check Code). The CRCC, one type of error detection code, is the remainder of data bits divided by a given number; the remainder is used as check bits.

Following the lead-in area is a program area in which audio data is recorded frame by frame as shown in FIG. 5. The control bits, P and Q, in subcodes of each frame are recorded as shown in FIG. 9. More specifically, the control bit P is data indicating an interval between pieces of music and inside a piece of music; the bit is set to 1 when the associated frame corresponds to the interval between pieces of music and audio data 303 and 305 (see FIG. 3) are not present, and is set to 0 when the frame corresponds to a point inside a piece of music and the audio data are present.

Various types of time data shown in FIG. 8 are recorded using the control bits Q. With regard to the subcodes, since 98 frames (time for one frame is 136.05$\mu$ sec) are treated as one subcoding frame, as described referring to FIG. 6, it is possible to record the time for one subcoding frame (136.05$\mu$ sec$\times$98), i.e., time data in the units of 1/75 second, using the control bits Q.

Referring to FIG. 8, the first and second four bits are the same as those of the control bits Q of the TOC data described referring to FIG. 7. The next eight bits indicate a track number (music number), and the following eight bits are an index which represents the details of the track number. The next three 8-bit sets represent absolute times indicating the times elapsed from the starting point of each piece of music expressed in terms of minutes, seconds and frame number, and the indication is updated every 1/75 second. The next eight bits are all "0." The subsequent three 8-bit set represent absolute times indicating the times elapsed till the point of the subcoding frame from the starting point of the program area with the accuracy of 1/75 second, as in the case of the TOC data described referring to FIG. 7. The last sixteen bits are an error detection code (CRCC).

The subcodes for 98 frames constitute one subcoding frame which corresponds to 1/75 second, as explained earlier referring to FIG. 4, so that a sequence of data for 75 subcoding frames is the same second data.

75 subcoding frames in the same second data are given sequential subcoding frame numbers, from 0 to 74, which have been called the frame numbers for short in the foregoing description.

If the all the TOC data described referring to FIG. 5 is read out, the absolute time data from the starting point of each piece of music corresponding to each music number can be detected in the unit of one subcoding frame, i.e., with the accuracy of 1/75 second.

Accordingly, in accessing each piece of data on a CD, the CD controller 103 reads out the TOC data to accurately access to the starting point of audio data of an arbitrary piece of music.

Brief Operation of the Embodiment brief operation of this embodiment will be described below. In the following description, autoplay data will be sometimes expressed as sequence data, but both are the same.

A user can cause the CD player section 100 to function as an ordinary CD player using the individual switches $102_1$–$102_6$ of the CD drive section 102 shown in FIG. 2. When the mode select switch $202_2$ on the instrument operating section 202 shown in FIG. 3 is operated to select the normal mode, the user can use the electronic keyboard instrument section 200 as an ordinary electronic keyboard instrument.

The user can perform the auto-playing operation with the electronic keyboard instrument section 200 in synchronism with the operation of the CD player section 100 to reproduce each piece of music on the CD 105. First, to store auto-play data, the user operate the mode select switch $202_2$ to select the sequencer write mode. In this mode, the user can store auto-play data into an auto-play memory 208 using the keyboard $202_1$of the instrument operating section 202 in accordance with a piece of music to be plated by the CD player section 100. In this case, every time a key-ON operation (key depression) is done, the instrument controller 201 receives CD absolute time data at that time from the CD controller 103 and stores the data together with play data associated with the key-ON into the auto-play memory 208.

The user can perform the following operation by operating the mode select switch $202_2$ of the instrument operating section 202 to select the sequencer priority mode, one of sequencer play modes. The user can arbitrarily select the timing of the auto-play data stored in the auto-play memory 208 at which auto-playing should start while viewing what is displayed on the display section 210 by operating the UP switch $202_5$ and DOWN switch $202_6$ of the instrument operating section 202. When the user operates the START switch $202_3$ of the instrument operating section 202 to start the auto-playing at the selected timing, reproduction of a piece of music starts at the timing corresponding to the audio data on the CD 105 in synchronism with the start of the auto-playing. This control is executed by the instrument controller 201 using the CD absolute time data stored together with a key-ON command in the auto-play memory 208 It is possible to execute the auto-playing operation without playing the CD 105.

Further, the user can perform the following operation by operating the mode select switch $202_2$ of the instrument operating section 202 to select the CD priority mode, one of the sequencer play modes. The user can arbitrarily select the timing to start autoplaying while reproducing the audio data recorded on the CD 105 by operating the FF switch $102_4$ or REW switch $102_5$ (FIG. 2) of the CD drive section 102. The user depresses the PAUSE switch $102_3$ of the CD drive section 102 to temporarily stop reproducing the audio data, then depresses the START switch $202_3$ (FIG. 3) of the instrument operating section 202. This operation can restart the reproduction of the audio data which has been in the paused state and can start auto-playing at the timing corresponding to the associated play contents in the auto-play memory 208 in synchronism with the restart of the data reproduction. As in the sequencer priority mode, this control is also carried out by the instrument controller 201 using the CD absolute time data stored together with the key-ON command in the auto-play memory 208.

The user can also perform the following operation by operating the mode select switch $202_2$ of the instrument operating section 202 to select the sequencer priority repeat mode, one of the sequencer play modes. The user can select the timing of the auto-play data stored in the auto-play memory 208 at which auto-play should start while viewing what is displayed on the display section 210 by operating the UP switch $202_5$ and DOWN switch $202_6$ (FIG. 3) of the instrument operating section 202. The content of the selection can be secured by operating the A switch $202_7$ (FIG. 3). Further, the user can likewise select the timing to end the auto-playing, and can secure the selected content by the operation of the B switch $202_8$ (FIG. 3). The user can also determine the repeat number to indicate how many times the playing range should be repeated, using the numerical keys $202_9$ (FIG. 3). When the user operates the START switch $202_3$ (FIG. 3) of the instrument operating section 202 to start the auto-playing at the selected timing secured by the A switch $202_7$, reproduction of a piece of music can be started at the timing corresponding to the audio data on the CD 105 in synchronism with the start of the auto-playing and the synchronized playing can continue to the timing secured by the B switch $202_8$. This control is executed using the CD absolute time data stored together with a key-ON command in the auto-play memory 208. The synchronized playing can be repeated by the number of times specified by using the numeric keys $202_9$.

Further, the user can perform the following operation by operating the mode select switch $202_2$ of the instrument operating section 202 to select the CD priority repeat mode, one of the sequencer play modes. The user can arbitrarily select the timing to synchronously start auto-playing while reproducing the audio data recorded on the CD 105 by depressing the PAUSE switch $102_3$ (FIG. 2) after the operation of the FF switch $102_4$ or REW switch $102_5$ of the CD drive section 102. The content of the selection can be secured by operating the A switch $202_7$ (FIG. 3). Subsequently, the reproduction of the audio data starts again from the paused point of time, whereby the user can select the timing to end the auto-playing of the electronic keyboard instrument section 200 in synchronism as done in the case of selecting the starting point. The selected content can be determined by the operation of the B switch $202_8$ (FIG. 3). As in the sequencer priority repeat mode, the user can also determine the repeat number, using the numerical keys $202_9$. When the user then operates the START switch $202_3$ (FIG. 3) of the instrument operating section 202, reproduction of the audio data starts at the timing determined by the A switch $202_7$ and the auto-playing can start from the corresponding timing of the associated content of the play in the auto-play memory 208 in synchronism with the start of the reproduction of the audio data. The synchronized playing can continue to the timing secured by the B switch $202_8$ and this operation can be repeated by the number of specified times. This control is also executed using the C absolute time data stored together with a key-ON command in the auto-play memory 208, as has been done in sequencer priority repeat mode.

The sequencer write mode, sequencer priority mode, CD priority mode, sequencer priority repeat mode and CD priority repeat mode will be described in detail in the named order.

Operation in Sequencer Write Mode

Figure 10:
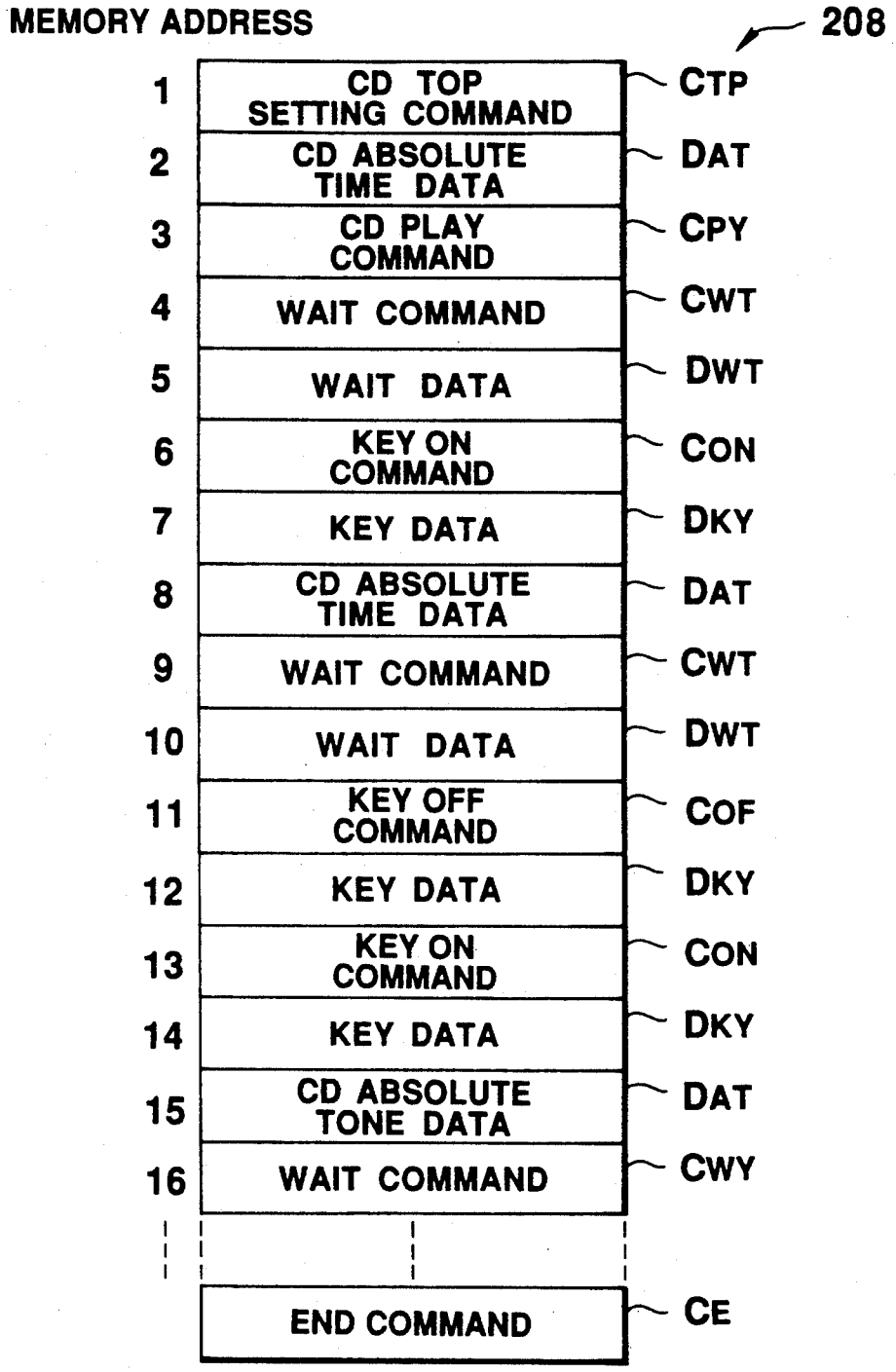
FIG. 10 is a diagram showing how data is stored in an auto-play memory (208)
Figure 11:
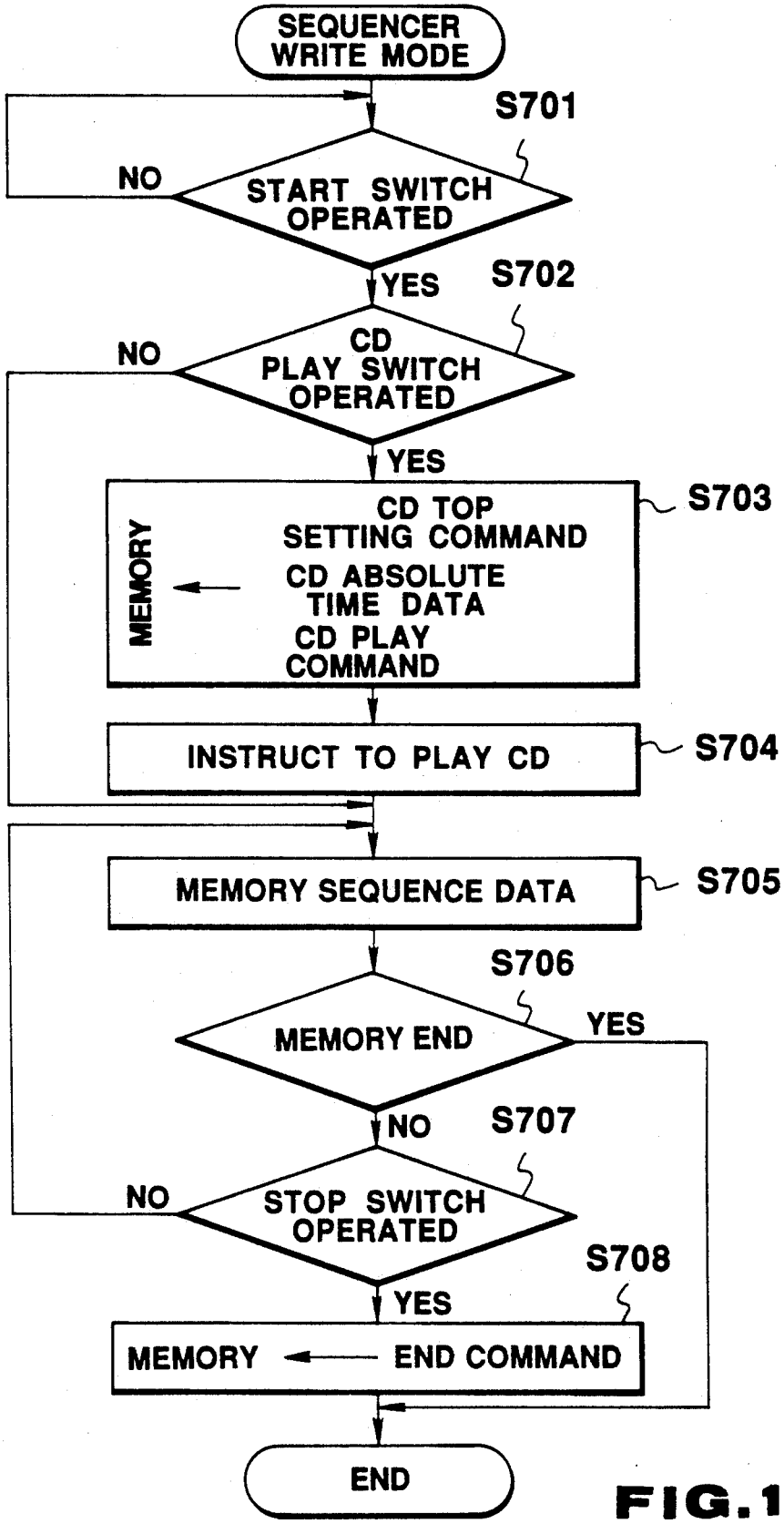
FIG. 11 is a flowchart illustrating a control operation in sequencer write mode.

To begin with, the operation in sequencer write mode will be discussed below. FIG. 11 is an operational flowchart illustrating the operation in this mode, while FIG. 10 illustrates the data structure in the auto-play memory 208. The following description will be given referring to these diagrams.

First, the user selects the sequencer write mode by operating the mode select switch $202_2$ (FIG. 3) of the instrument operating section 202.

Then, to reproduce audio data recorded on the CD 105 in synchronism with the auto-playing, the user performs the following operation. More specifically, the user operates the numerical keys $102_6$ of the CD drive section 102 to select and specify the music number of the CD 105 which is wanted to be reproduced in synchronism with the auto-playing, then depresses the PLAY switch $102_1$. At this time, the CD controller 100 in the CD player section 100 accesses the TOC memory 101 to read out music number data associated with the number specified by the numerical keys $102_6$ and CD absolute time data. The CD controller 103 controls the optical pickup 107 through the servo controller 104 to move the pickup 107 to the position on the CD 105 corresponding to the CD absolute time data. Accordingly, a piece of music on the CD 105 is selected and the top of the music piece is set. The CD controller 103 outputs the CD absolute time data read from the TOC memory 101 to the instrument controller 201. In this state, reproduction of the audio data has not been conducted yet.

When it is unnecessary to reproduce a piece of music on the CD 105 in synchronism with the auto-playing, the user will not operate the CD drive section 102.

After the above operation, the CD controller 103 starts the operational flowchart shown in FIG. 11.

First, it is determined in step S701 whether or not the START switch $202_3$ of the instrument operating section 202 has been depressed.

If the START switch $202_3$ has been depressed, it is then determined in step S702 whether or not the PLAY switch $102_1$ of the CD drive section 102 has been depressed in advance.

If the user has depressed in advance the PLAY switch $102_1$ to play a piece of music on the CD 105 in synchronism with the auto-playing, the decision in step S702 becomes YES and the flow advances to step S703.

In step S703, a CD top setting command $C_{TP}$ is written at a memory address 1 in the auto-play memory 208 as shown in FIG. 10. CD absolute time data $D_{AT}$ indicating the top of the piece of music on the CD 105, which is to be reproduced in synchronism with the auto-playing and has been sent from the CD controller 103 in advance, is likewise written at a memory address 2, as shown in FIG. 10. Further, CD play command $C_{PY}$ is written at a memory address 3 as shown in FIG. 10. These functions will be discussed later.

Then, in step S704, a CD play instruction is given to the CD controller 103. As a result, the CD controller 103 in the CD player section 100 drives the disk motor 106 through the servo controller 104. Consequently, the audio data of the music piece which has already been selected and whose top has been set by the user is read out from the CD 105 via the optical pickup 107, demodulator 109 and audio data signal processor 111, and is then sent from the D/A converter 112 to the loudspeaker 115 through the LPF 113 and amplifier 114. The amplified data is released from the loudspeaker 115.

The user plays the keyboard $202_1$ of the instrument operating section 202 in accordance with a piece of music reproduced in this manner from the CD 105. Accordingly, every time the process of step S705 in the repetitive operational sequence from S705, to S706, to S707 and back to S705, play data input from the keyboard $202_1$ is sequentially written as sequence data in the auto-play memory 208 as shown in FIG. 10. The sequence data includes a wait command $C_{WT}$ and wait data $D_{WT}$, key-ON command $C_{ON}$ and key data $D_{KY}$, key-OFF command $C_{OF}$ and key data $D_{KY}$, CD absolute time data $D_{AT}$, etc. as shown in FIG. 10.

Referring to FIG. 10, the wait command $C_{WT}$ serves to hold the execution of next play data for a time specified by the wait data $D_{WT}$, which is generated by the timer circuit 209 shown in FIG. 4. Every time a playing operation is executed, a reset signal RST is input via an OR circuit $209_5$ (FIG. 4) to a timer counter $209_2$ from the instrument controller 201, resetting this counter. Thereafter, the timer counter $209_2$ performs its count-up operation according to a clock from a reference clock generator $209_1$. The instrument controller 201 fetches the count output of the timer counter $209_2$ as the wait data $D_{WT}$ at the time the next play data is received, then writes the wait data $D_{WT}$ into the auto-play memory 208 and resets the timer counter $209_2$ using the reset signal RST. Through the above operation, the time from one playing operation to the next playing operation is measured, and is stored as the wait data $D_{WT}$ in the auto-play memory 208. The wait command $C_{WT}$ and wait data $D_{WT}$ at a memory address 4 in FIG. 10 indicate the time to the first key operation after depression of the START switch $202_3$ of the instrument operating section 202 by the user.

The key-ON command $C_{ON}$ serves to instruct the start of generation of a musical tone with the pitch specified by the key data $D_{KY}$.

The key-OFF command $C_{OF}$ serves to instruct to stop the generation of a musical tone with the pitch specified by the key data $D_{KY}$.

Further, every time a key-ON operation is conducted, the CD controller 103 receives the CD absolute time data $D_{AT}$ from the CD 105 detected at that time from the CD controller 103, and writes it at the memory address next to that of the key data $D_{KY}$ following the key-ON command $C_{ON}$. In this manner, the timing of a music piece reproduced by the CD player section 100 at the time of each key-ON operation is recorded in the auto-play memory 208.

When the user depresses the STOP switch $202_4$ (see FIG. 3) of the instrument operating section 202, this event is detected in step S707, and an end command $C_E$ is written in the auto-play memory 208 as shown in FIG. 10 in step S708, terminating the sequencer write mode.

When the sequence data is written at the last memory address in the auto-play memory 208 during the play of the music piece, the decision in S706 becomes YES and the sequencer write mode is forcibly terminated.

If the user does not need to play a piece of music on the CD 105 in synchronism with the auto-playing, the PLAY switch $102_1$ has not been depressed in advance and the decision in S702 becomes NO. In this case, the CD top setting command $C_{TP}$, the CD absolute time data $D_{AT}$ indicating the top of the music piece and the CD play command $C_{PY}$ will not be written in the auto-play memory 208, nor is a play instruction given to the CD player section 100. The flow then jumps to step S705 where the sequence data is written in the auto-play memory 208. In S705, writing the CD absolute time data $D_{AT}$ into the auto-play memory 208 for each key-ON command $C_{ON}$ will not be done. This operation corresponds to writing of auto-play data in the conventional electronic musical instrument having an auto-playing function.

Operation in Sequencer Priority Mode

A description will now be given of an operation to execute the auto-playing after the above writing of the auto-play data, referring to FIGS. 12A to 12D. To begin with, a discussion will be given of the case where the user operates the mode select switch $202_2$ of the instrument operating section 202 to select the sequencer priority mode, one of the sequencer play modes.

Figure 12A:
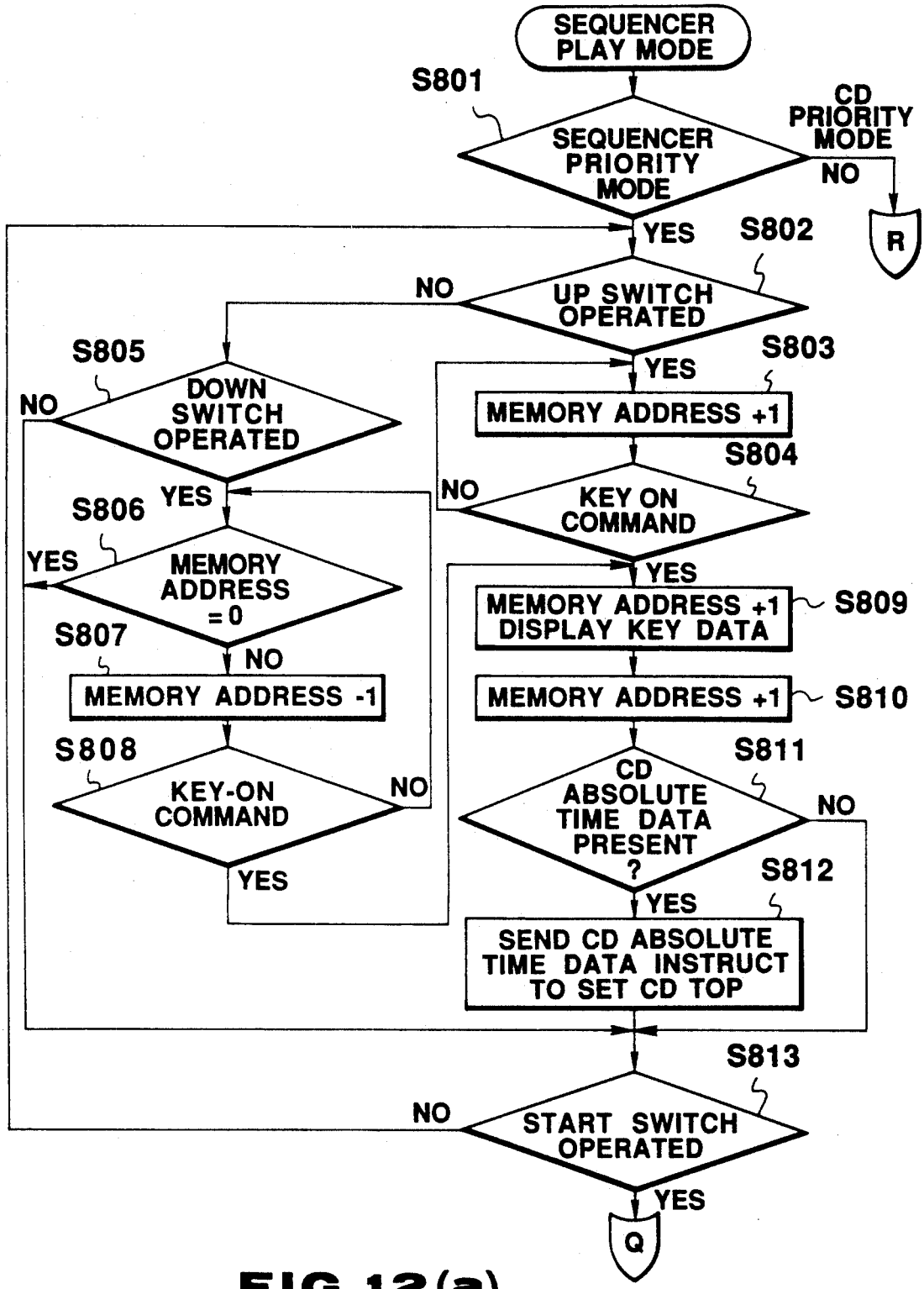
FIGS. 12A to 12D are flowcharts illustrating control operations in sequencer priority mode and CD priority mode.
Figure 12B:
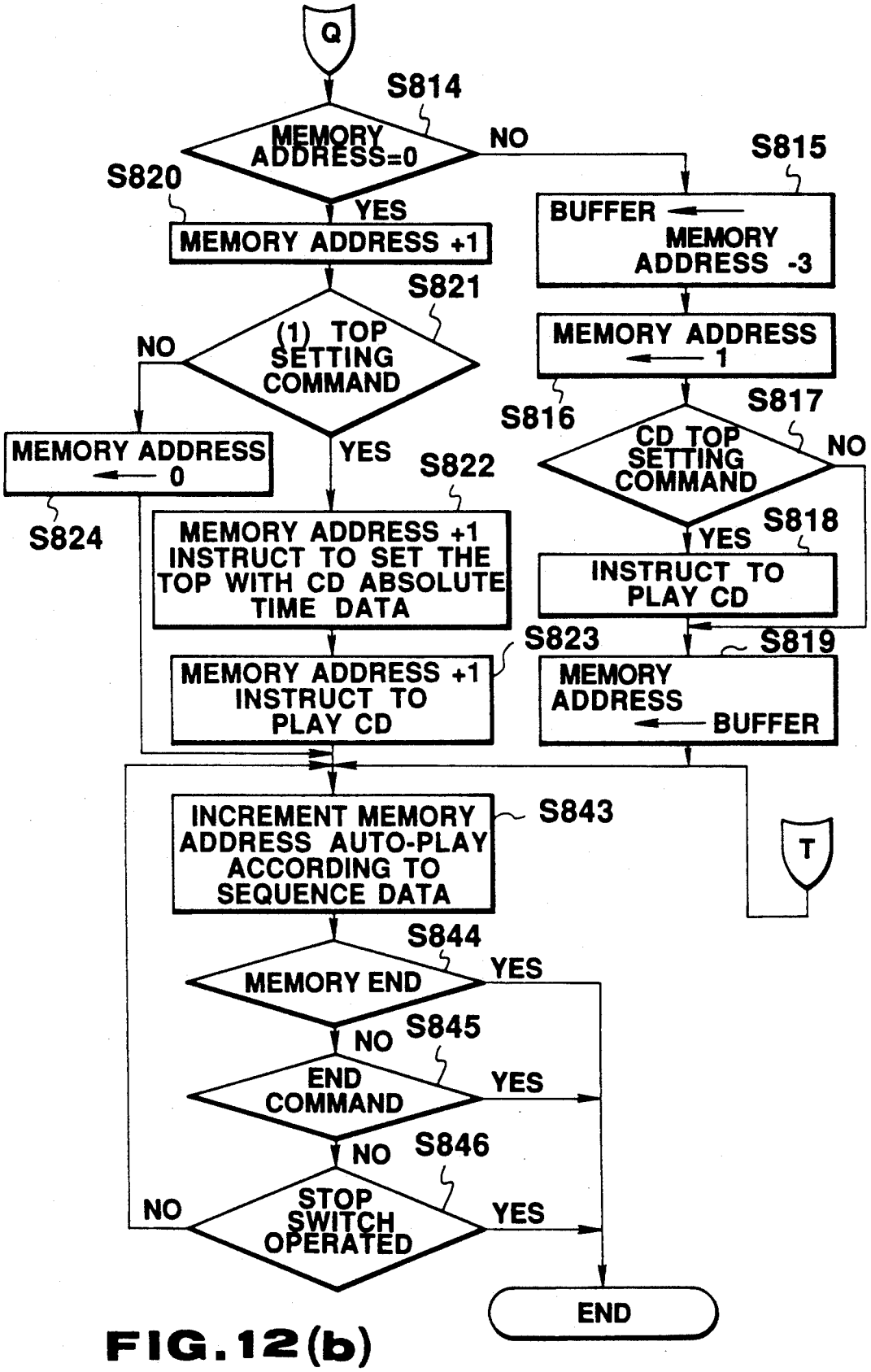

In this case, the instrument controller 201 in FIG. 1 executes the operational flowchart shown in FIGS. 12A and 12B, and the decision in step S801 (FIG. 12A) becomes YES.

First, the user arbitrarily selects the timing of the content of the play data stored in the auto-play memory 208 as shown in FIG. 10 at which auto-play should start, using the UP switch $202_5$ and DOWN switch $202_6$ (FIG. 3) of the instrument operating section 202 and the display section 210. This operation is realized as follows under the control of the instrument controller 201.

In step S802, it is determined whether or not the

UP switch $202_5$ of the instrument operating section 202 has been depressed.

When the UP switch $202_5$ has been depressed, the decision in S802 becomes YES and the memory address on the auto-play memory 208 is incremented by an address counter (not particularly shown) to advance to the address where the next key-ON command $C_{ON}$ is stored. In other words, the memory address in the auto-play memory 208 is incremented by "1" in step S803 and this address increment is repeated until the key-ON command $C_{ON}$ is detected in step S804.

When the key-ON command $C_{ON}$ is detected, the decision in S804 becomes YES, the present memory address is incremented by "+1" in step S809 and the key data $D_{KY}$ stored at the memory address in the auto-play memory 208 next to where the key-ON command $C_{ON}$ is stored is read out. This key data $D_{KY}$ is then displayed on the display section 210 shown in FIG. 1, thus permitting the user to confirm the presently-specified key data $D_{KY}$ in the auto-play memory 208.

Subsequently, the memory address is further incremented by "+1" in step S810, and it is determined in step S811 whether or not the CD absolute time data $D_{AT}$ exists at that memory address. If the user performs an operation to write the sequence data into the auto-play memory 208 with the PLAY switch $102_1$ depressed in advance in order to play a piece of music, recorded on the CD 105, in synchronism with the auto-playing, the CD absolute time data $D_{AT}$ is stored in the auto-play memory 208 at the next address to the address of the key data $D_{KY}$ following each key-ON command $C_{ON}$ as shown in FIG. 10. In this case, therefore, the decision in S811 becomes YES.

As a result, the CD absolute time data $D_{AT}$ corresponding to the wait data $D_{WT}$ presently displayed on the display section 210 is read out from the auto-play memory 208 and is transferred to the CD controller 103 in step S812. Meanwhile, the instrument controller 201 gives an instruction to set the CD top to the CD controller 103. The CD controller 103 in turn controls the optical pickup 107 through the servo controller 104 to set the top position on the CD 105 corresponding to the aforementioned CD absolute time data $D_{AT}$.

If the user performs an operation to write the sequence data into the auto-play memory 208 without depressing the PLAY switch $102_1$ in advance because there is no need to play a piece of music, recorded on the CD 105, in synchronism with the auto-playing in the aforementioned sequencer write mode, the CD absolute time data $D_{AT}$ is not stored in the auto-play memory 208. In this case, therefore, the decision in S811 becomes NO. In this case, since it is unnecessary to play a music piece on the CD 105 at the time of auto-playing, no instruction to set the CD top will be given in step S812.

In the subsequent step S813, it is determined whether or not the START switch $202_3$ (FIG. 3) of the instrument operating section 202 has been depressed; if this switch has been depressed, the flow returns to S802.

If it is judged in the aforementioned step S802 that the UP switch $202_5$ (FIG. 3) of the instrument operating section 202 has not been depressed, i.e., if the decision is NO, the flow advances to S805 where it is determined whether or not the DOWN switch $202_6$ (FIG. 3) of the instrument operating section 202 has been depressed.

When the DOWN switch $202_6$ has been depressed, the decision in S805 becomes YES and the memory address on the auto-play memory 208 is decremented by an address counter (not particularly shown) to return to the memory address where the previous key-ON command $C_{ON}$ is stored. In other words, the memory address in the auto-play address decrement is repeated until the key-ON command $C_{ON}$ is detected in step S808. When the memory address is decremented to "0," no further decrement is executed and the flow jumps to step S813.

When the key-ON command $C_{ON}$ is detected, the decision in S808 becomes YES, and thereafter, the operational sequence from S809 to S813 is executed to display the decremented memory address, set the top of a music piece on the CD 105 and detect the depression of the START switch $202_3$, as in the aforementioned case where the UP switch $202_5$ is depressed.

Every time the UP switch $202_5$ or DOWN switch $202_6$ is depressed, the memory address on the auto-play memory 208 is incremented or decremented in the above manner so that the start point of the auto-play can be moved to the position desired by the user.

The above operation is repeated until the START switch $202_3$ of the instrument operating section 202 is depressed and the decision in S813 becomes YES. While neither the START switch $202_3$ nor DOWN switch $202_6$ is depressed, the processing loop from S802, to S805, to S813, then back to S802 is repeated to be ready for depression of either switch.

As the user operates the UP switch $202_5$ or DOWN switch $202_6$ to move the start point of the auto-playing to the desired position, then depresses the START switch $202_3$ (FIG. 3) of the instrument operating section 202, the auto-playing by the electronic keyboard instrument section 200 and the synchronized reproduction by the CD player section 100 will be executed as follows.

That is, when the START switch $202_3$ is depressed, the decision in S813 becomes YES, and it is determined in S814 whether or not the present memory address is "0."

When the present memory address is not "0," the decision in S814 (FIG. 12B) becomes NO and the flow advances to S815.

In S815, a value acquired by decrementing the present memory address by "3" is saved in a buffer (not particularly shown) in the instrument controller 201. The content of the present memory address indicates the memory address where the CD absolute time data $D_{AT}$ next to the key data $D_{KY}$ following the key-ON command $C_{ON}$ is stored in the aforementioned process of S804 to S810. Therefore, the content of the buffer acquired by decrementing this value by "3" indicates one memory address previous to the position of the key-ON command $C_{ON}$ specified by the user. The meaning of this will be described later.

Then, the content of the memory address is set to "1" in S816, and it is determined in S817 whether or not the CD top setting command $C_{TP}$ exists in the memory address "1."

In a case where the user performs an operation to write sequence data in the auto-play memory 208 by depressing the PLAY switch $102_1$ in advance in order to play a piece of music recorded on the CD 105 in synchronism with the auto-playing in the aforementioned sequencer write mode, the CD top setting command $C_{TP}$ is stored at the memory address "1" in the auto-play memory 208 as shown in FIG. 10. In this case, therefore, the decision in S817 becomes YES. Accordingly, an instruction to play a piece of music recorded on the CD 105 is given to the CD controller 103 in S818. The play start timing in this case is the point where the CD top setting has been done in the aforementioned step S812.

After the above operation, the address data saved in the buffer in S815 is set again at the memory address in S819. This content indicates one memory address precious to the position of the key-ON command $C_{ON}$ specified by the user, as described earlier. This process is to give matching with the process of S843 (to be described later).

If the user performs an operation to write sequence data in the auto-play memory 208 without depressing the PLAY switch $102_1$ in advance in the sequencer write mode because it is unnecessary to play a piece of music on the CD 105 in synchronism with the auto-playing, the CD top setting command $C_{TP}$ is not stored in the auto-play memory 208 (see step S702 in FIG. 11). In this case, therefore, the decision in S817 becomes NO. In this case, it is unnecessary to play a piece of music recorded on the CD 105 at the auto-playing time, so that no CD play instruction in S818 will be given.

If the present memory address is "0"at the time the decision in S813 is YES, the decision in S814 becomes YES and the flow advances to S820. There is a case where the user depresses the START switch $202_3$ without depressing the UP switch $202_5$ or DOWN switch $202_6$ at all after operating the mode select switch $202_2$ of the instrument operating section 202 to select the sequencer priority mode, or where the user depresses the UP switch $202_5$ several times, then depresses the DOWN switch $202_6$ the same number of times so that the decision in S806 becomes YES.

The present memory address is incremented by "1" in S820, and it is then determined in S821 whether or not the CD top setting command $C_{TP}$ exists at the memory address. Since the present memory address is "0," the content of the memory address when incremented by "1" becomes "1."

As in the case of S817, if the user performs an operation to write sequence data in the auto-play memory 208 by depressing the PLAY switch $102_1$ in advance in order to play a piece of music recorded on the CD 105 in synchronism with the auto-playing in the aforementioned sequencer write mode, the CD top setting command $C_{TP}$ is stored at the memory address "1" in the auto-play memory 208 as shown in FIG. 10. In this case, therefore, the decision in S821 becomes YES. Accordingly, the content of the memory address is further incremented by "1" to be "2" in S822. The CD absolute time data, stored at the memory address 2 as shown in FIG. 10, which indicates the top of a piece of music that should be reproduced in synchronism with the auto-playing, is read out from the auto-play memory 208 and is transferred to the CD controller 103. At the same time, the CD top setting command is given to the CD controller 103. Further, the memory address is incremented by "1" to be "3" in S823. Based on the CD play command $C_{PY}$ stored at the memory address "3," a CD play instruction is given to the CD controller 103. The play start timing in this case is the top of the music piece whose top has been set in the aforementioned step S822. The content of the memory address indicates one memory address previous to the top memory address "4" where the sequence data concerning the play data is stored. This is the result of the user specifying the top of a music piece as the timing to start the auto-playing. This relation is the same as in the case of the aforementioned S819.

If the user performs an operation to write sequence data in the auto-play memory 208 without depressing the PLAY switch $102_1$ in advance in the sequencer write mode because it is unnecessary to play a piece of music recorded on the CD 105 in synchronism with the auto-playing, the CD top setting command $C_{TP}$ is not stored in the auto-play memory 208 (see step S702 in FIG. 11). In this case, therefore, the decision in S821 becomes NO. In this case, it is unnecessary to play a piece of music recorded on the CD 105 at the auto-playing time, so that the CD top setting command in S822 and the CD play instruction in S823 will not be given. In this case, the content of the memory address is set again in S824. The content of the memory address indicates one memory address previous to the top memory address "1" where the sequence data concerning the play data is stored. This is the result of the user specifying the top of a music piece as the timing to start the auto-playing. This relation is the same as in the case of the aforementioned S819.

As described above, after the play command is given to the CD player section 100, every time the process of S843 in the repetitive sequence of S843 to S846, then back to S843 is executed, the sequence data is read out from each memory address while the memory address of the auto-play memory 208 is sequentially incremented from the memory address set in S819, S823 or S824, and the auto-playing operation is executed in accordance with the content of the sequence data. The address increment in this case is executed on the basis of the operation of the timer circuit 209 which will be described later.

For instance, when the instrument controller 201 reads out the key-ON command $C_{ON}$ from the memory address "6" in FIG. 10, it further reads out the next key data $D_{KY}$ and instructs the tone generator 203 to start generating a musical tone with the pitch corresponding to the key data.

When the instrument controller 201 reads out the key-OFF command $C_{OF}$ from the memory address "11" in FIG. 10, it then reads out the next key data $D_{KY}$ and instructs the tone generator 203 to stop generating the presently-generated musical tone with the pitch corresponding to the key data.

Further, the increment of the memory address is realized as follows. That is, when the instrument controller 201 reads out the wait command $C_{WT}$ from the memory address "9" in FIG. 10, it further reads out the wait data $D_{WT}$ and sets the data in a wait register $209_3$ in the timer circuit 209 shown in FIG. 4. Meanwhile, the timer counter $209_2$ in the timer circuit 209 is reset at the previous timing of incrementing the memory address, as described later. Thereafter, the timer counter $209_2$ in FIG. 4 is sequentially counted up in accordance with the clock from the reference clock generator $209_1$. The output of the timer counter $209_2$ is compares with the wait data $D_{WT}$ set in the wait register $209_3$ by a comparator $209_4$. When they coincide with each other, the comparator $209_4$ outputs a signal indicating the coincidence as an address increment signal INC. This signal INC is sent to the instrument controller 201 which in turn increments the memory address in the autoplay memory 208 from which data is to be read out. In the timer circuit shown in FIG. 4, the address increment signal INC resets the wait register $209_3$ as well as the timer counter $209_2$ through the OR circuit $209_5$ to be ready for a process to the next wait data $D_{WT}$. Through the above operation, the timing from one playing operation to the next one is measured and the auto-playing is realized.

The above auto-playing operation will be terminated when the sequence data at every memory address up to the last memory address in the auto-play memory 208 is read out during the auto-playing, or when the end command $C_E$ is read out from the auto-play memory 208 during the auto-playing, or when the user depresses the STOP switch $202_4$ of the instrument operating section 202, and when such an event is detected in S844, S845 or S846.

Operation in CD Priority Mode

Then, referring to FIG. 12, a discussion will be given of the case where the user operates the mode select switch $202_2$ of the instrument operating section 202 to select the CD priority mode, one of the sequencer play modes.

Figure 12C:
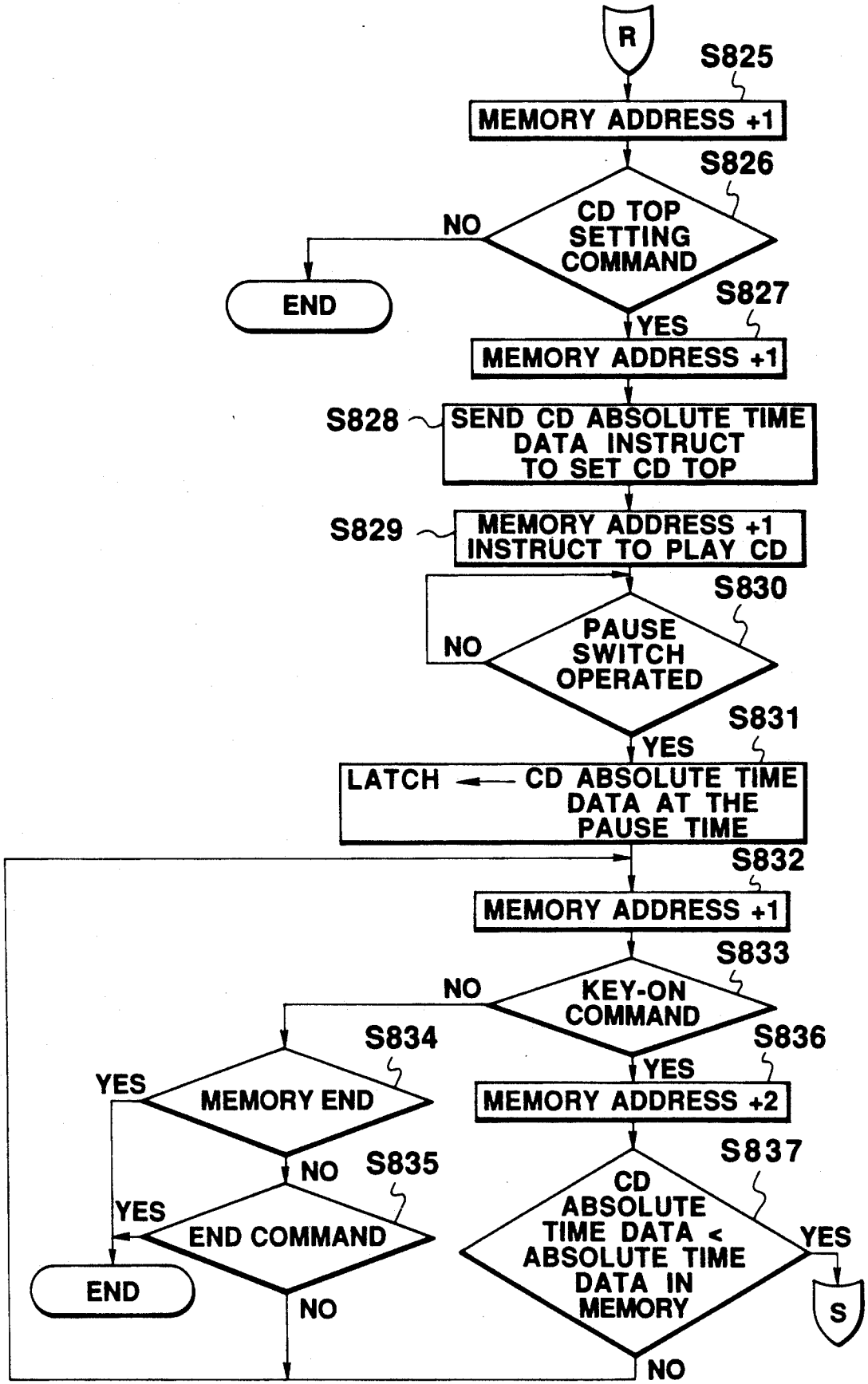

In this case, the instrument controller 201 in FIG. 1 executes the operational flowchart shown in FIG. 12A, and the decision in step S801 (FIG. 12A) becomes YES and the flow advances to S825 in FIG. 12C.

In S825, the content of the memory address is incremented by "1." Since the memory address is initially reset to "0," the memory address after the increment becomes "1."

In the subsequent step S826, it is determined whether or not the CD top setting command $C_{TP}$ is stored at the memory address "1." If the user performs an operation to write the sequence data into the auto-play memory 208 with the PLAY switch $102_1$ depressed in advance in order to play a piece of music, recorded on the CD 105, in synchronism with the auto-playing, the CD top setting command $C_{TP}$ is stored in the auto-play memory 208 at the memory address "1" as shown in FIG. 10. In this case, therefore, the decision in S826 becomes YES. If the user performs an operation to write the sequence data into the auto-play memory 208 without depressing the PLAY switch $102_1$ in advance because there is no need to play a piece of music, recorded on the CD 105, in synchronism with the auto-playing in the aforementioned sequencer write mode, the CD top setting command $C_{TP}$ is not stored at the memory address "1" in the auto-play memory 208. In this case, therefore, the decision in S826 becomes NO. In this case, since it is unnecessary to play a music piece on the CD 105 at the time of auto-playing and it is insignificant to set the CD priority mode, the process will be terminated without executing anything.

If the decision in S825 becomes YES in the former case, the flow advances to S827 where the present memory address "1" is further incremented by "1" to be "2."

In step S828, the CD absolute time data $D_{AT}$ from the top of the piece of music to be reproduced from the CD 105 in the auto-playing is read out from the memory address "2" and is transferred to the CD controller 103. Meanwhile, the instrument controller 201 gives an instruction to set the CD top to the CD controller 103. The CD controller 103 in turn controls the optical pickup 107 through the servo controller 104 to set the top position on the CD 105 corresponding to the aforementioned CD absolute time data $D_{AT}$.

In the next step S829, the content of the memory address is incremented by "1" to be "3." Based on the CD play command $C_{PY}$ stored at the memory address "3," a CD play instruction is given to the CD controller 103. As a result, the CD player section 100 starts playing the CD 105 from the top of the piece of music whose top has been set in S828.

In this state, the user can arbitrarily select the timing to synchronously start the auto-playing of the electronic keyboard instrument section 200 while reproducing the audio data recorded on the CD 105 by operating the FF switch $102_4$ and REW switch $102_5$ (FIG. 2) of the CD drive section 102.

The instrument controller 201 determines through the CD controller 103 in S830 whether the PAUSE switch $102_3$ (FIG. 2) of the CD drive section 102 has been depressed. When the user has depressed the PAUSE switch $102_3$, the reproduction of the audio data is paused under the control of the CD controller 103.

In the subsequent step S831, the instrument controller 201 receives the CD absolute time data $D_{AT}$ at the pause time from the CD controller 103, and holds it in a latch circuit (not particularly shown).

Every time the process of S832 in the repetitive process sequence from S832, to S833, to S834, to S835, then back to S832 is executed following the above operation, the memory address is incremented by "1," and every time the process of S833 is executed, it is determined whether or not the content of the memory address is the key-ON command $C_{ON}$.

When the key-ON command $C_{ON}$ is detected in S833 in the above repetitive process sequence, the decision in that step becomes YES and the flow advances to S836. In S836, the memory address where the command is stored is incremented by "2." At this memory address (e.g., memory address "8" in FIG. 10) is stored the CD absolute time data $D_{AT}$ corresponding to the detected key-ON command $C_{ON}$.

In S837, the CD absolute time data $D_{AT}$ corresponding to the detected key-ON command $C_{ON}$ is read out from that memory address and it is determined whether or not this data exceeds (or is greater than) the aforementioned, latched CD absolute time data at the pause time. If the former data does not exceed the latter, it means that the memory address in the auto-play memory 208 has not reached the position corresponding to the timing at the pause time. The flow then returns to S832 and the process sequence of S832 to S835 is repeated to retrieve the next key-ON command $C_{ON}$ on the auto-play memory 208.

Every time the process of S834 in the above repetitive process is executed, it is judged whether or not the memory address on the auto-play memory 208 has reached the last address (memory end), or upon every execution of the process of S835, it is judged whether or not the end command $C_E$ has been read out from the auto-play memory 208. When the decision in S834 or S835 becomes YES, which means that no corresponding sequence data exists on the memory 208, the process will be terminated without doing anything on the side of the electronic keyboard instrument section 200.

Figure 12D:
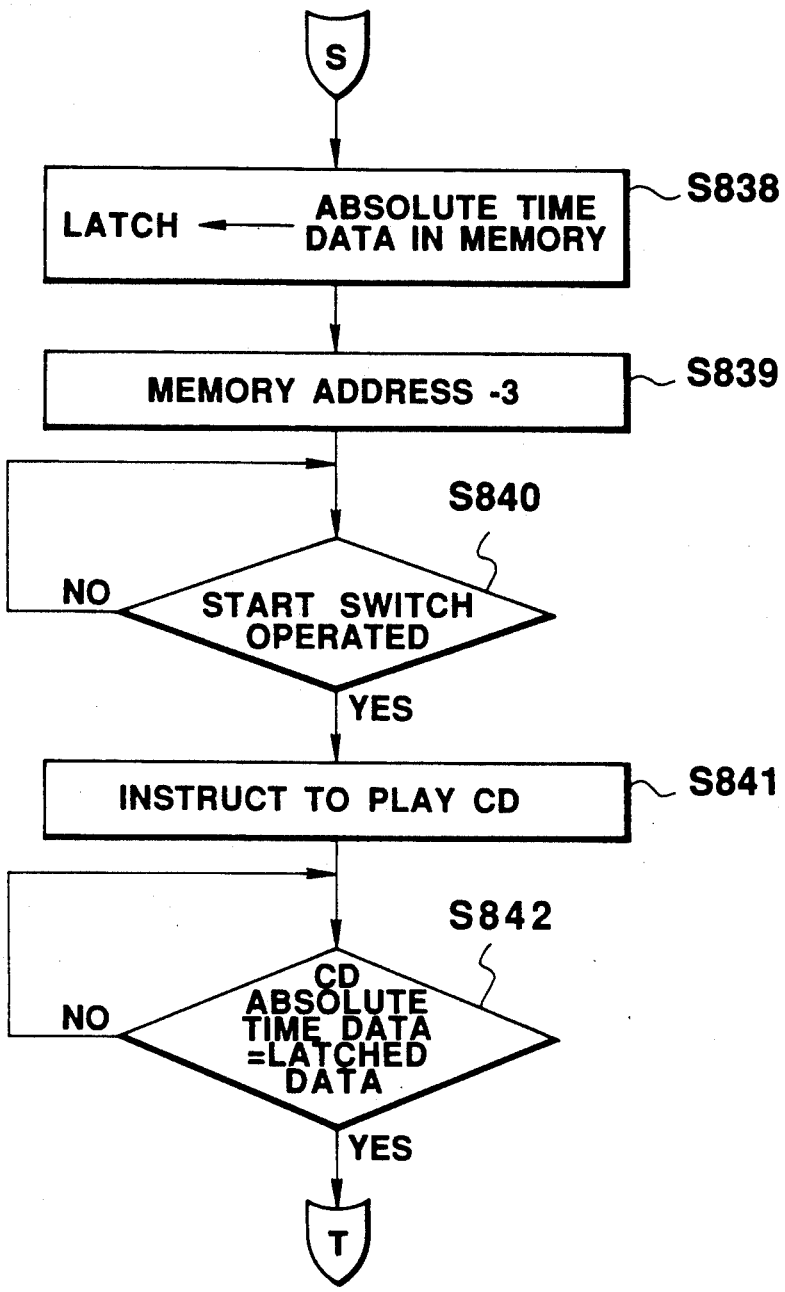

If the CD absolute time data $D_{AT}$ corresponding to the detected key-ON command $C_{ON}$ from the auto-play memory 208 exceeds the above-mentioned, latched CD absolute time data at the pause time in S837, the decision in this step becomes YES and the flow advances to S838 (FIG. 12D).

In this step S838, the detected CD absolute time data $D_{AT}$ is held in the aforementioned latch circuit. Since what has been previously held in the latch circuit becomes unnecessary, it is deleted.

In the subsequent step S839, the present memory address is decremented by "3." This memory address indicates the address where the first C absolute time data $D_{AT}$ which has exceeded the CD absolute time data at the pause time is stored through the process of S836, e.g., at the address "8" in FIG. 10. Therefore, the memory address after decremented by "3" indicates one address previous to the address like the address "5" in FIG. 10 where the key-ON command $C_{ON}$ corresponding to the CD absolute time data $D_{AT}$ is stored. This process is done to provide the matching with the process of S843 which will be described later. This relation is the same as the case of the aforementioned step S819.

In S840 after the above operation, depression of the START switch $202_3$ (FIG. 3) of the instrument operating section 202 is waited.

When the user depresses the START switch $202_3$, the decision in S840 becomes YES and an instruction to play a piece of music on the CD 105 is given to the CD controller 103 in the subsequent step S841.

In the next step S842, the instrument controller 201 receives the CD absolute time data sequentially detected from the CD 105 through the subcode signal processor 110 by the CD controller 103, and determines whether or not the received data equals the aforementioned content of the latch circuit. The latch circuit is holding the first CD absolute time data $D_{AT}$ on the auto-play memory 208 which has exceeded the CD absolute time data at the pause time.

As in the above-described sequencer priority mode, every time the process of S843 in the repetitive process sequence from steps S843 to S846 in FIG. 12B, then back to S843 is executed, the memory address of the auto-play memory 208 is sequentially incremented from the one set in S819, S823 or S824 and the sequence data is read out from each memory address; the auto-playing operation is carried out in accordance with the content of the sequence data.

Reproduction of the audio data in the paused state can start and the auto-playing can start from the corresponding timing of the associated play content on the auto-play memory 208 in synchronism with the start of the reproduction, in the above manner.

Operation in Sequence Priority Repeat Mode

A description will now be given of an operation to execute the auto-playing in a repeat state after the above writing of the auto-play data shown in FIG. 11. To begin with, a discussion will be given of the case where the user operates the mode select switch $202_2$ of the instrument operating section 20 to select the sequencer priority repeat mode, one of the sequencer play modes.

Figure 13A:
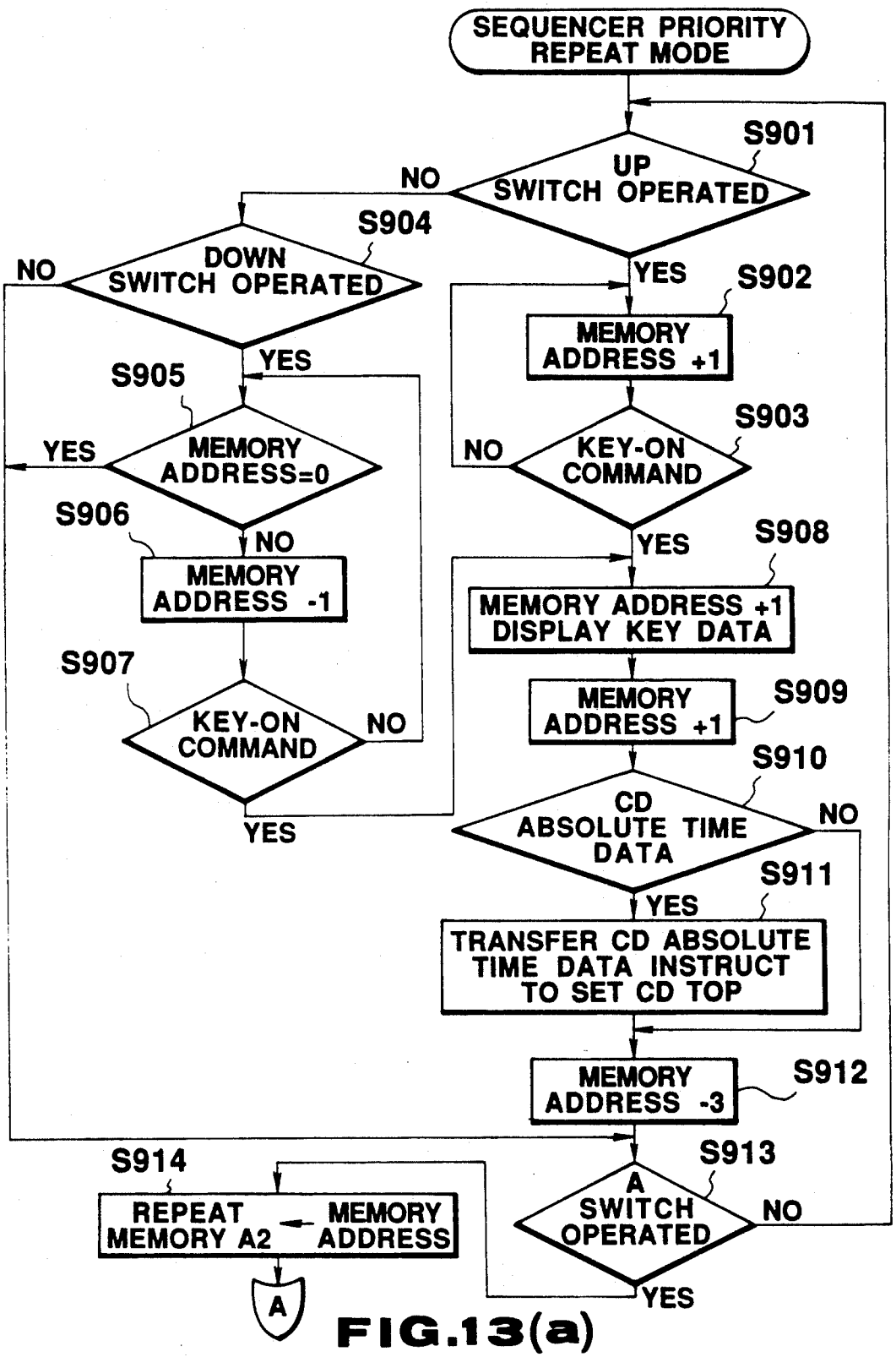
FIGS. 13A to 13E are flowcharts illustrating a control operation in sequencer priority repeat mode.
Figure 13B:
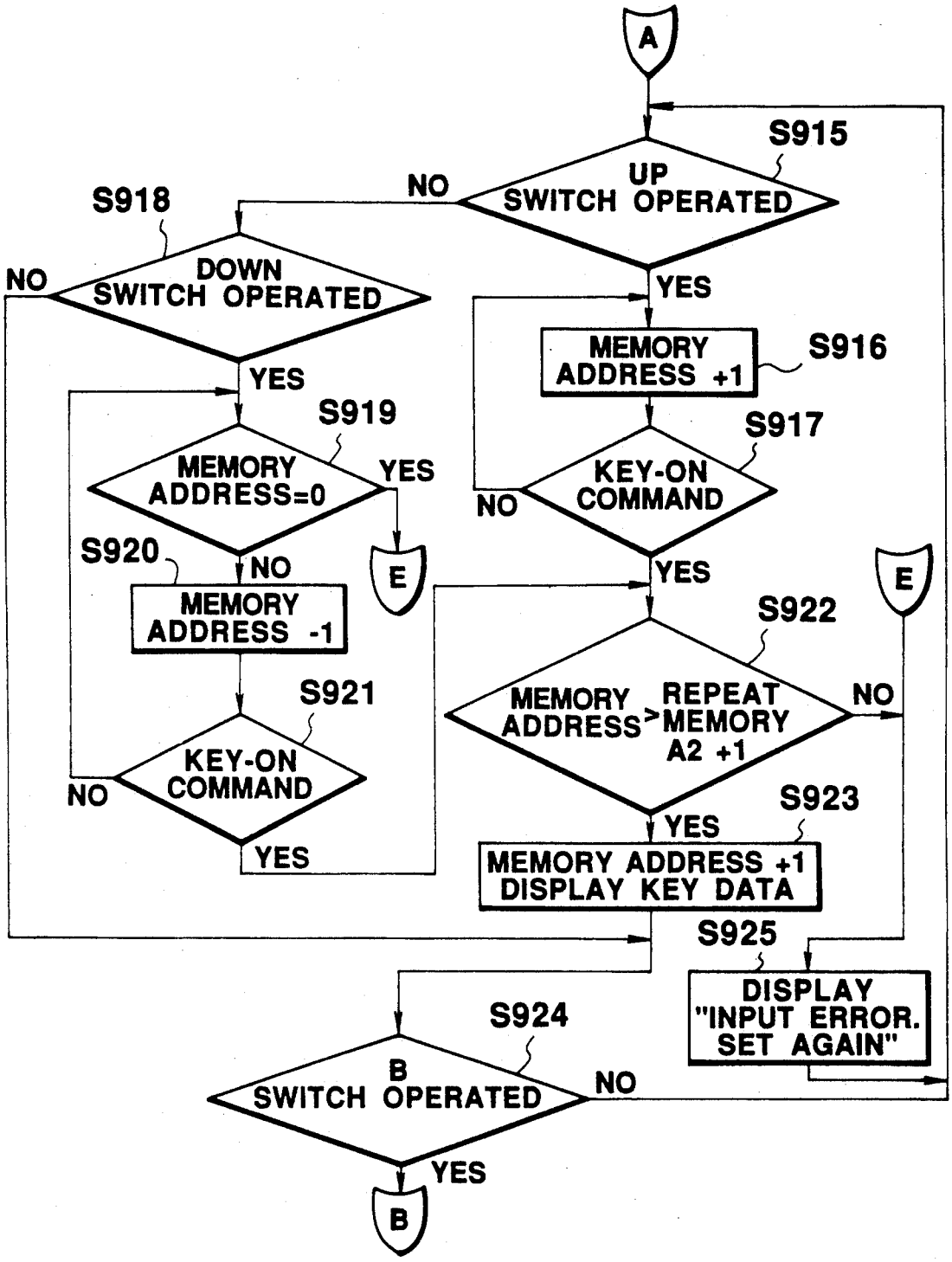
Figure 13C:
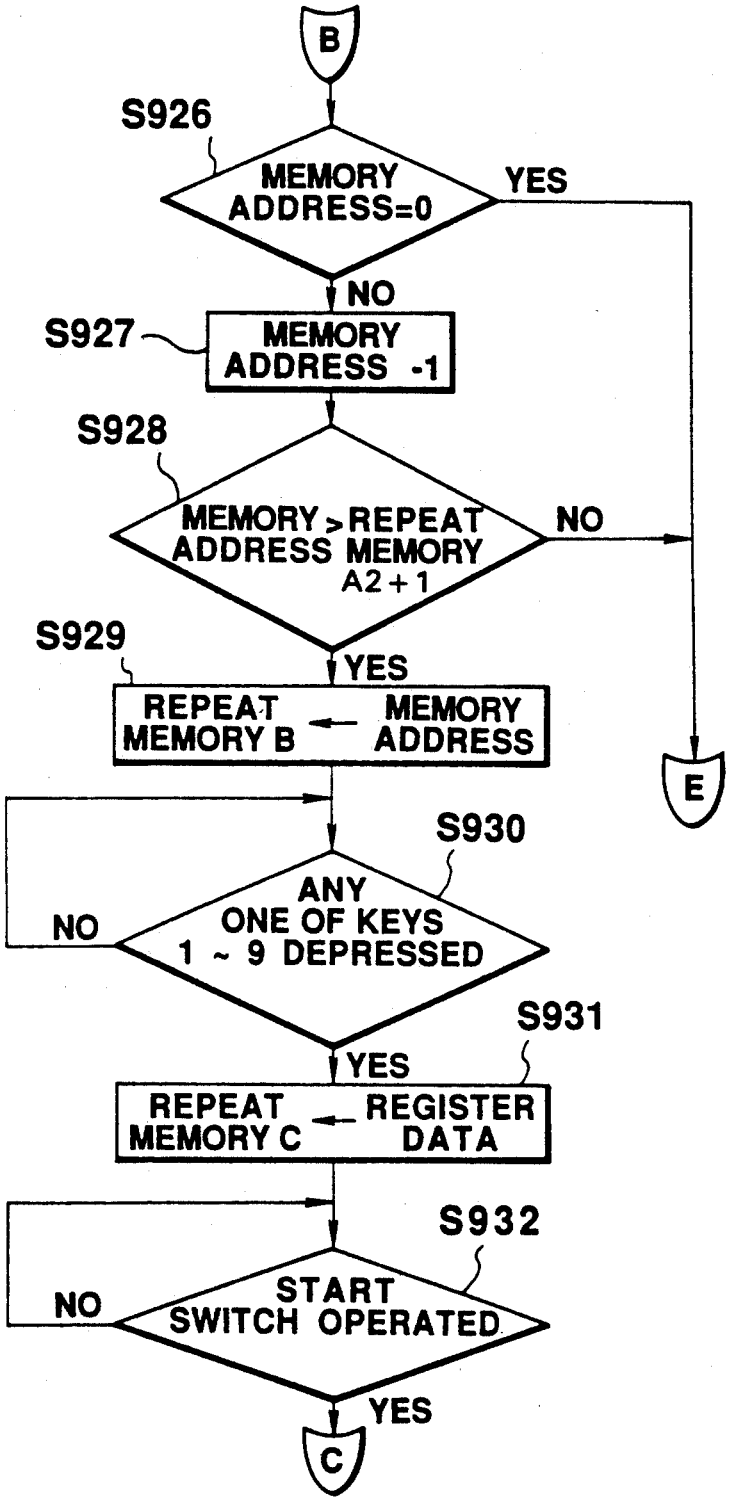
Figure 13D:
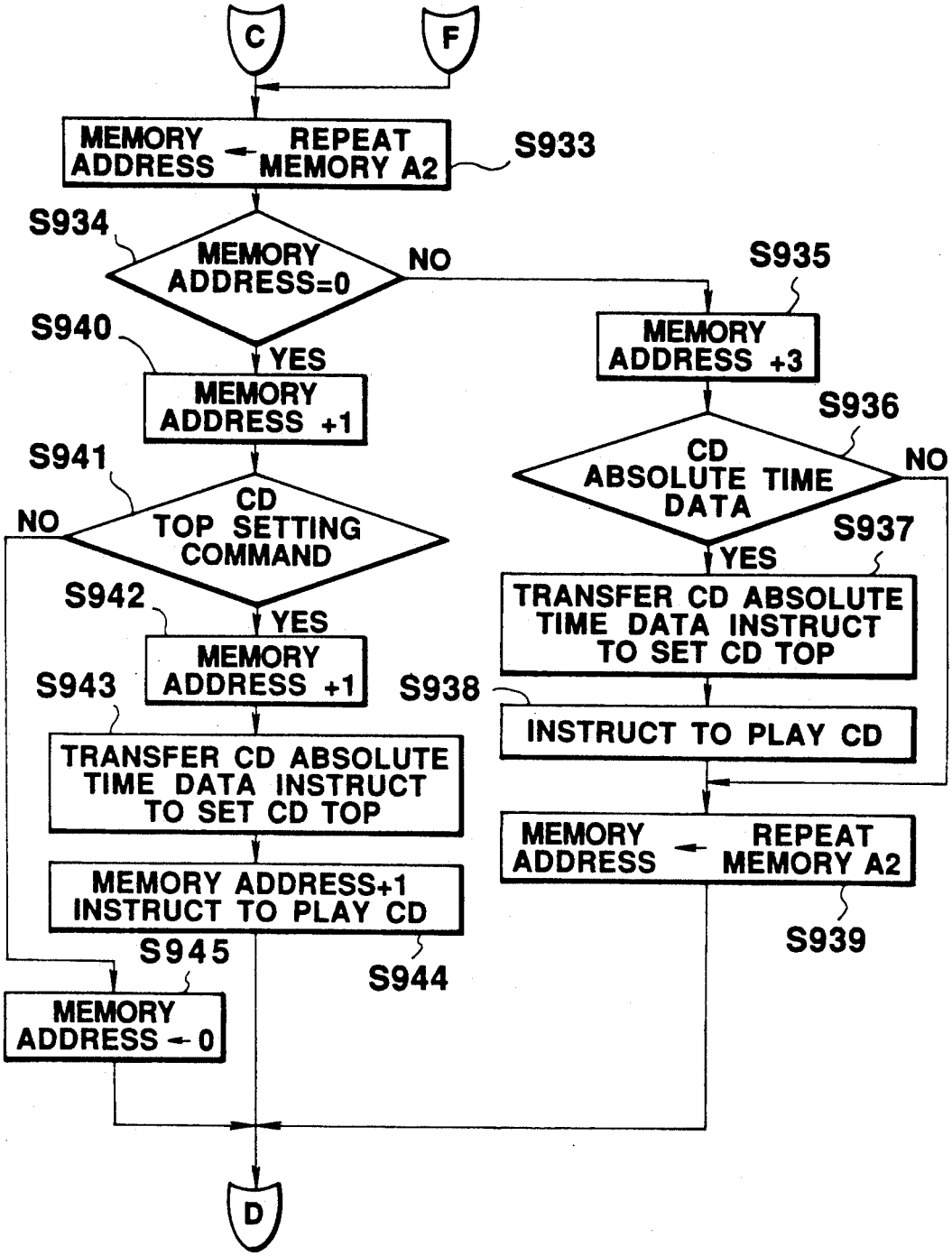
Figure 13E:
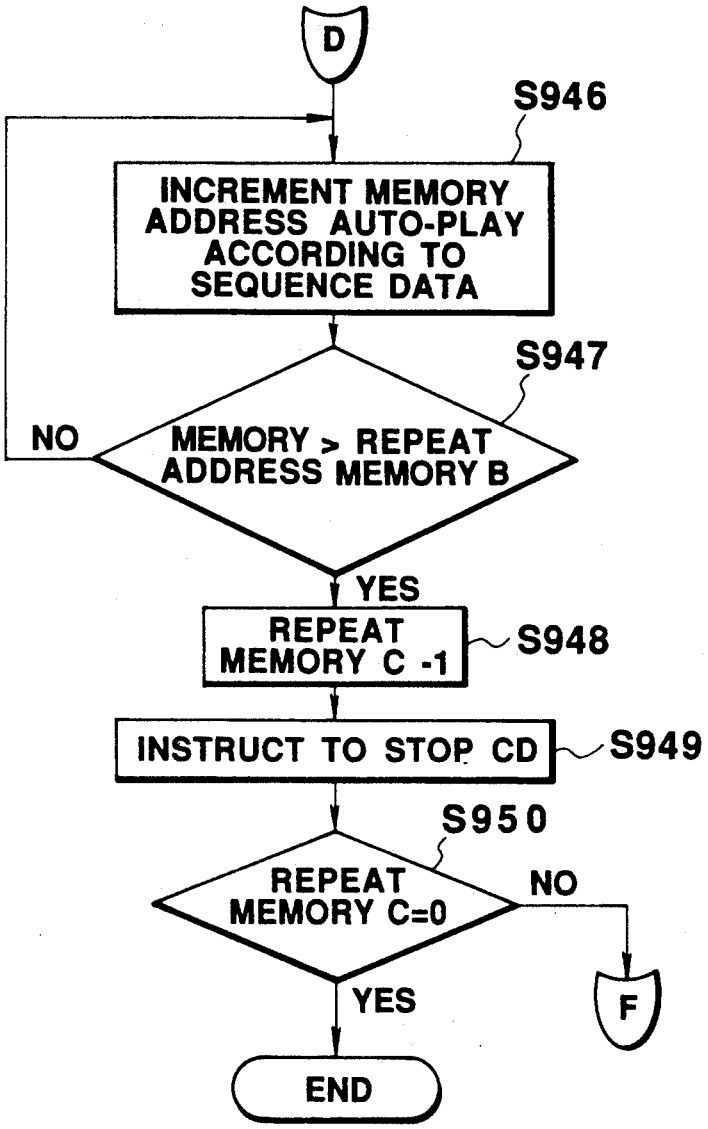

In this case, the instrument controller 201 in FIG. 1 executes the operational flowchart shown in FIGS. 13A and 13E.

First, the user arbitrarily selects the timing of the content of the play data stored in the auto-play memory 208 as shown in FIG. 10 at which auto-play should start, using the UP switch $202_5$ and DOWN switch $202_6$ (FIG. 3) of the instrument operating section 202 and the display section 210. This operation is realized as the processes of S901 to S914 in FIG. 13A.

In step S901, it is determined whether or not the UP switch $202_5$ of the instrument operating section 202 has been depressed.

When the UP switch $202_5$ has been depressed, the decision in S901 becomes YES and the memory address on the auto-play memory 208 is incremented by an address counter (not particularly shown) to advance to the address where the next key-ON command $C_{ON}$ is stored. In other words, the memory address in the auto-play memory 208 is incremented by "1" in step S902 and this address increment is repeated until the key-ON command $C_{ON}$ is detected in step S903.

When the key-ON command $C_{ON}$ is detected, the decision in S903 becomes YES, the present memory address is incremented by "+1" in step S908 and the key data $D_{KY}$ stored at the memory address in the auto-play memory 208 next to where the key-ON command $C_{ON}$ is stored is read out. This key data $D_{KY}$ is then displayed on the display section 210 shown in FIG. 1, thus permitting the user to confirm the presently-specified key data $D_{KY}$ in the auto-play memory 208.

Subsequently, the memory address is further incremented by "1" in step S909, and it is determined in step S910 whether or not the CD absolute time data $D_{AT}$ exists at that memory address. If the user performs an operation to write the sequence data into the auto-play memory 208 with the PLAY switch $102_1$ depressed in advance in order to play a piece of music, recorded on the CD 105, in synchronism with the auto-playing, the CD absolute time data $D_{AT}$ is stored in the auto-play memory 208 at the next address to the address of the key data $D_{KY}$ following each key-ON command $C_{ON}$ as shown in FIG. 10. In this case, therefore, the decision in S910 becomes YES.

As a result, the CD absolute time data $D_{AT}$ corresponding to the wait data $D_{WT}$ presently displayed on the display section 210 is read out from the autoplay memory 208 and is transferred to the CD controller 103 in step S911. Meanwhile, the instrument controller 201 gives an instruction to set the CD top to the CD controller 103. The CD controller 103 in turn controls the optical pickup 107 through the servo controller 104 to set the top position on the CD 105 corresponding to the aforementioned CD absolute time data $D_{AT}$.

If the user performs an operation to write the sequence data into the auto-play memory 208 without depressing the PLAY switch $102_1$ in advance because there is no need to play a piece of music, recorded on the CD 105, in synchronism with the auto-playing in the aforementioned sequencer write mode, the CD absolute time data $D_{AT}$ is not stored in the auto-play memory 208. In this case, therefore, the decision in S910 becomes NO. In this case, since it is unnecessary to play a music piece on the CD 105 at the time of auto-playing, the process of S911 will not be executed.

After the above operation, a value acquired by decrementing the present memory address by "3" is held in a buffer (not particularly shown) in the instrument operating section 201 in S912. The content of the present memory address indicates the memory address where the CD absolute time data $D_{AT}$ next to the key data $D_{KY}$ following the key-ON command $C_{ON}$ is stored in the aforementioned steps S903-S909. Therefore, the content of the buffer acquired by decrementing this value by "3" indicates one memory address previous to the position of the key-ON command $C_{ON}$ specified by the user. This meaning will be described later.

In the subsequent step S913, it is determined whether or not the A switch $202_7$ (FIG. 3) of the instrument operating section 202 has been depressed; if this switch has been depressed, the flow returns to S901.

If it is judged in the aforementioned step S901 that the UP switch $202_5$ (FIG. 3) of the instrument operating section 202 has not been depressed, i.e., if the decision is NO, the flow advances to S904 where it is determined whether or not the DOWN switch $202_6$ (FIG. 3) of the instrument operating section 202 has been depressed.

When the DOWN switch $202_6$ has been depressed, the decision in S904 becomes YES and the memory address on the auto-play memory 208 is decremented by an address counter (not particularly shown) to return to the memory address where the previous key-ON command $C_{ON}$ is stored. In other words, the memory address in the auto-play memory 208 is decremented by "1" in step S906 and this address decrement is repeated until the key-ON command $C_{ON}$ is detected in step S907. When the memory address is decremented to "0," no further decrement is executed and the flow jumps to step S913.

When the key-ON command $C_{ON}$ is detected, the decision in S907 becomes YES, and thereafter, the operational sequence from S908 to S911 is executed to display the decremented memory address, store the CD absolute 20 time data $D_{AT}$ into the repeat memory A1, decrement the memory address by "3" and detect the depression of the A switch $202_7$, as in the aforementioned case where the UP switch $202_5$ is depressed.

Every time the UP switch $202_5$ or DOWN switch $202_6$ is depressed, the memory address on the auto-play memory 208 is incremented or decremented in the above manner so that the start point of the auto-play can be moved to the position desired by the user.

The above operation is repeated until the A switch $202_7$ of the instrument operating section 202 is depressed and the decision in S913 becomes YES. While neither the START switch $202_3$ nor DOWN switch $202_6$ is depressed, the processing loop from S901, to S904, to S913, then back to S901 is repeated to be ready for depression of either switch.

As the user operates the UP switch $202_5$ or DOWN switch $202_6$ to move the start point of the auto-playing to the desired position, then depresses the A switch $202_7$ (FIG. 3) of the instrument operating section 202, the decision in S913 becomes YES and the flow advances to S914. In S914, the content of the present memory address is stored in a repeat memory A2 (not particularly shown) in the instrument operating section 201. The content of the present memory address indicates one memory address previous to the position of the key-ON command $C_{ON}$ on the auto-play memory 208 specified by the user in the aforementioned step S912. As a result, the memory address at the start of the auto-playing is determined.

Then, the user can arbitrarily select the auto-playing stop timing of the auto-play data stored in the auto-play memory 208 as shown in FIG. 10, in the same manner as done in the operation to specify the start of the auto-playing. This process is realized as the process sequence of S915 to S929 shown in FIG. 13B.

The user operates the UP switch $202_5$ or DOWN switch $202_6$ (FIG. 3) of the instrument operating section 202 to increment or decrement the memory address while searching for the key-ON command $C_{ON}$ on the auto-play memory 208. This process is executed as the process sequence of S915-S921. These processes are almost the same as those of S901-S907 in the operation to specify the start of the auto-playing. When the memory address being "0" is detected in S919, however, the flow jumps to S925 where an error message "Input error. Set again" is displayed, then the processing from S915 is repeated. This is because that the memory address cannot become "0" as the start of the auto-playing has already been specified.

Every time the memory address is changed, the process of S922 is executed. That is, it is determined whether or not the content of the changed memory address exceeds the content of the repeat memory A2 incremented by "1." Since the content of the repeat memory A2 indicates one memory address previous to the position of the key-ON command $C_{ON}$ on the auto-play memory 208 at the start of the auto-playing specified by the user as described above, this memory content incremented by "1" is the memory address where the key-ON command $C_{ON}$ on the auto-play memory 208 at the start of the auto-playing specified by the user is stored. Since the memory address specified as the end of the auto-playing cannot exceed the memory address specified as the start of the auto-playing, the error message is displayed in S925 if the decision in S922 becomes NO, and the processing from S915 will be repeated.

If the decision in S922 is YES, the flow advances to S923 where the present memory address is incremented by "1," and the key data $D_{KY}$ stored at the memory address in the auto-play memory 208 next to where the key-ON command $C_{ON}$ is stored is read out and displayed on the display section in FIG. 1.

In the subsequent step S924, it is determined whether or not the B switch $202_8$ (FIG. 3) of the instrument operating section 202 has been depressed. If this switch has not been depressed, the flow returns to S915.

As described above, as the user operates the UP switch $202_5$ or DOWN switch $202_6$ to move the end of the auto-playing to the desired position, then depresses the B switch $202_8$ of the instrument operating section 202, the decision in S924 becomes YES.

In S926 shown in FIG. 13C, as in the step S919, it is determined whether or not the content of the memory address is "0." This is the process in a case where neither the UP switch $202_5$ nor DOWN switch $202_6$ has been depressed at all and the decisions in S915 and S918 both become NO. The meaning of this process is the same as that of S919.

Then, the present memory address is decremented by "1" in S927. As the present memory address indicates the memory address (see FIG. 10) where the key data $D_{KY}$ is stored through the aforementioned step S923, the present memory address when decremented by "1" becomes the memory address, specified as the end of the autoplaying, in the auto-play memory 208 where the key-ON command $C_{ON}$ is stored.

Further, in S928 as in S922, it is judged whether or not the content of the memory address exceeds the content of the repeat memory A2 incremented by "1." This is the process in a case where neither the UP switch $202_5$ nor DOWN switch $202_6$ has been depressed at all and the decisions in S915 and S918 both become NO. The meaning of this process is the same as that of S922.

After the above operation, the content of the present memory address is stored in a repeat memory B (not particularly shown) in the instrument operating section 201 shown in FIG. 1. The content of the present memory address indicates the memory address in the auto-play memory 208 specified by the user in the aforementioned step S927. As a result, the memory address at the end of the auto-playing is determined.

In the above manner, the user specifies the start and the end of the auto-playing, then specifies the repeat number to repeat the auto-playing in that range. This process is realized as the processes of S930 and S931 shown in FIG. 13C.

In S930, depression of any of the numerical keys $202_9$ (FIG. 3), "1" to "9," of the instrument operating section 202 is detected.

When any of the keys is depressed, register data corresponding to the depressed key is stored in a repeat memory C (not shown) in the instrument controller 201 in S931.

Through the above process, the repeat number for the auto-playing is specified.

After the above sequence of operations, the user depresses the START switch $202_3$ (FIG. 3) of the instrument operating section 202 to execute the auto-playing operation by the electronic keyboard instrument section 200 and the synchronized reproduction by the CD player section 100.

When the START switch $202_3$ is depressed, the decision in S932 becomes YES, then the content of the repeat memory A2 or the value of one memory address previous to the position of the key-ON command $C_{ON}$ in the auto-play memory 208 at the start of the auto-playing specified by the user is set at the memory address in step S933 shown in FIG. 13D.

Further, it is determined in S934 whether or not the present memory address is "0."

If the present memory address is not "0," the decision in S934 becomes NO and the flow advances to S935.

In S935, the content of the memory address is incremented by "3" and the resultant memory content indicates the address in the auto-play memory 208 where the CD absolute time data $D_{AT}$ associated with the key-ON command $C_{ON}$ at the start of the auto-playing is stored (see FIG. 10).

Then, in S936 it is determined whether or not the CD absolute time data $D_{AT}$ exists at that memory address. If the user performs an operation to write the sequence data into the auto-play memory 208 with the PLAY switch $102_1$ depressed in advance in order to play a piece of music, recorded on the CD 105, in synchronism with the auto-playing, the CD absolute time data $D_{AT}$ is stored in the auto-play memory 208 at the next address to the address of the key data $D_{KY}$ following each key-ON command $C_{ON}$ as shown in FIG. 10. In this case, therefore, the decision in S936 becomes YES.

As a result, the CD absolute time data $D_{AT}$ associated with the key-ON command $C_{ON}$ in the auto-play memory 208 at the start of the auto-playing is read out from the above memory address and is transferred to the CD controller 103. Meanwhile, the instrument controller 201 gives an instruction to set the CD top to the CD controller 103. The CD controller 103 in turn controls the optical pickup 107 through the servo controller 104 to set the top position on the CD 105 corresponding to the aforementioned CD absolute time data $D_{AT}$.

In the subsequent step S938, an instruction to play a piece of a music recorded on the CD 105 is given to the CD controller 103. The timing to play the music piece is synchronized with the start of the auto-playing specified by the user in the above manner.

After the above operation, the content of the repeat memory A2 is set again at the memory address in S939. As described earlier, the memory content indicates one memory address previous to the position of the key-ON command $C_{ON}$ in the auto-play memory 208 at the start of the auto-playing specified by the user. The specifying the memory address previous by one is to provide the matching with the process of step S946 which will be described later.

If the user performs an operation to write the sequence data into the auto-play memory 208 without depressing the PLAY switch $102_1$ in advance because there is no need to play a piece of music, recorded on the CD 105, in synchronism with the auto-playing in the aforementioned sequencer write mode, the CD top setting command $C_{TP}$ is not stored in the auto-play memory 208 (see S702 in FIG. 11). In this case, therefore, the decision in S936 becomes NO. In this case, since it is unnecessary to play a music piece on the CD 105 at the time of auto-playing, the CD play instruction or the like in steps S937 and S938 will not be executed.

If the present memory address is "0" at the time the content of the repeat memory A2 is set at the memory address in S933, the decision in S934 becomes YES and the flow advances to S940. The is a case where the user depresses the A switch $202_7$ without depressing the UP switch $202_5$ or DOWN switch $202_6$ at all after operating the mode select switch 2022 of the instrument operating section 202 to select the sequencer priority repeat mode, or where the user depresses the UP switch $202_5$ several times, then depresses the DOWN switch $202_6$ the same number of times so that the decision in S905 becomes YES.

The present memory address is incremented by "1" in S940, and it is then determined in S941 whether or not the CD top setting command $C_{TP}$ exists at the memory address. Since the present memory address is "0," the content of the memory address when incremented by "1" becomes "1."

As in the case of S936, if the user performs an operation to write sequence data in the auto-play memory 208 by depressing the PLAY switch $102_1$ in advance in order to play a piece of music recorded on the CD 105 in synchronism with the auto-playing in the aforementioned sequencer write mode, the CD top setting command $C_{TP}$ is stored at the memory address "1" in the auto-play memory 208 as shown in FIG. 10. In this case, therefore, the decision in S941 becomes YES. Accordingly, the content of the memory address is further incremented by "1" to be "2" in S942. The CD absolute time data, stored at the memory address 2 as shown in FIG. 10, which indicates the top of a piece of music that should be reproduced in synchronism with the auto-playing, is read out from the auto-play memory 208 and is transferred to the CD controller 103. At the same time, the CD top setting command is given to the CD controller 103. Further, the memory address is incremented by "1" to be "3" in S943. Based on the CD play command $C_{PY}$ stored at the memory address "3," a CD play instruction is given to the CD controller 103. The play start timing in this case is the top of the music piece whose top has been set in the aforementioned step S942. The content of the memory address indicates one memory address previous to the top memory address "4" where the sequence data concerning the play data is stored. This is the result of the user specifying the top of a music piece as the timing to start the auto-playing. This relation is the same as in the case of the aforementioned S939.

If the user performs an operation to write sequence data in the auto-play memory 208 without depressing the PLAY switch $102_1$ in advance in the sequencer write mode because it is unnecessary to play a piece of music recorded on the CD 105 in synchronism with the auto-playing, the CD top setting command $C_{TP}$ is not stored in the auto-play memory 208 (see step S702 in FIG. 11). In this case, therefore, the decision in S941 becomes NO. In this case, it is unnecessary to play a piece of music recorded on the CD 105 at the auto-playing time, so that the CD top setting command in S943 and the CD play instruction in S942 will not be given. In this case, the content of the memory address is set again in S945. The content of the memory address indicates one memory address previous to the top memory address "1" where the sequence data concerning the play data is stored. This is the result of the user specifying the top of a music piece as the timing to start the auto-playing. This relation is the same as in the case of the aforementioned S939.

As described above, after the play command is given to the CD player section 100, every time the process of S946 in the repetitive sequence of S946 and S947 shown in FIG. 13E is executed, the sequence data is read out from each memory address while the memory address of the auto-play memory 208 is sequentially incremented from the memory address set in S939, S944 or S945, and the auto-playing operation is executed in accordance with the content of the sequence data. The address increment in this case is executed on the basis of the operation of the timer circuit 209.

For instance, when the instrument controller 201 reads out the key-ON command $C_{ON}$ from the memory address "6" in FIG. 10, it further reads out the next key data $D_{KY}$ and instructs the tone generator 203 to start generating a musical tone with the pitch corresponding to the key data.

When the instrument controller 201 reads out the key-OFF command $C_{OF}$ from the memory address "11" in FIG. 10, it then reads out the next key data $D_{KY}$ and instructs the tone generator 203 to stop generating the presently-generated musical tone with the pitch corresponding to the key data.

Further, the increment of the memory address is realized as follows. That is, when the instrument controller 201 reads out the wait command $C_{WT}$ from the memory address "9" in FIG. 10, it further reads out the wait data $D_{WT}$ and sets the data in a wait register $209_3$ in the timer circuit 209 shown in FIG. 4. Meanwhile, the timer counter $209_2$ in the timer circuit 209 is reset at the previous timing of incrementing the memory address, as described later. Thereafter, the timer counter $209_2$ in FIG. 4 is sequentially counted up in accordance with the clock from the reference clock generator $209_1$. The output of the timer counter $209_2$ is compares with the wait data $D_{WT}$ set in the wait register $209_3$ by a comparator $209_4$. When they coincide with each other, the comparator $209_4$ outputs a signal indicating the coincidence as an address increment signal INC. This signal INC is sent to the instrument controller 201 which in turn increments the memory address in the auto-play memory 208 from which data is to be read out. In the timer circuit shown in FIG. 4, the address increment signal INC resets the wait register $209_3$ as well as the timer counter $209_2$ through the OR circuit $209_5$ to be ready for a process to the next wait data $D_{WT}$. Through the above operation, the timing from one playing operation to the next one is measured and the auto-playing is realized.

The above-described operation for a single auto-playing is terminated as the memory address for the sequence data exceeds the content of the repeat memory B, causing the decision in S947 to be YES. That is, since the content of the repeat memory B indicates the memory address where the key-ON command $C_{ON}$ in the auto-play memory 208 at the end of the auto-playing specified by the user is stored, the first auto-playing will be terminated after executing the commands up to this key-ON command $C_{ON}$ in S946.

Then, the content of the repeat memory C is decremented by "1" in S948. As the repeat number of the auto-playing specified by the user is stored in the repeat memory C, the memory content is decremented by "1" every time the single auto-playing is terminated.

After the above operation, an instruction to stop the reproduction is given to the CD controller 103 in S949, thus terminating the operation to play the CD. This process will not be executed in a case where the auto-playing is performed by the electronic keyboard instrument section 200 without performing the reproduction by the CD player section 100. In the next step S950, it is determined whether or not the content of the repeat memory C becomes "0." The content of the repeat memory C is decremented by "1" in S948 every time the single auto-playing is terminated. If the memory content is not "0," the decision in S950 becomes NO and the flow returns to S933 (FIG. 13D). As a result, the operation for the synchronized autoplaying is repeated as described above.

When the content of the repeat memory C becomes "0," the decision in S950 becomes NO and the processing in sequencer priority repeat mode is terminated.

Operation in CD Priority Repeat Mode

Then, a discussion will be given of the case where the user operates the mode select switch $202_2$ of the instrument operating section 202 to select the CD priority repeat mode, one of the sequencer play modes.

In this case, the instrument controller 201 in FIG. 1 executes the operational flowchart shown in FIGS. 14A to 14F.

In S1001 (FIG. 14A), the content of the memory address is incremented by "1." Since the memory address is initially reset to "0," the memory address after the increment becomes "1."

In the subsequent step S1002, it is determined whether or not the CD top setting command $C_{TP}$ is stored at the memory address "1." If the user performs an operation to write the sequence data into the auto-play memory 208 with the PLAY switch $102_1$ depressed in advance in order to play a piece of music, recorded on the CD 105, in synchronism with the auto-playing, the CD top setting command $C_{TP}$ is stored in the auto-play memory 208 at the memory address "1" as shown in FIG. 10. In this case, therefore, the decision in S1002 becomes YES. If the user performs an operation to write the sequence data into the auto-play memory 208 without depressing the PLAY switch $102_1$ in advance because there is no need to play a piece of music, recorded on the CD 105, in synchronism with the auto-playing in the aforementioned sequencer write mode, the CD top setting command $C_{TP}$ is not stored at the memory address "1" in the auto-play memory 208. In this case, therefore, the decision in S1002 becomes NO. In this case, since it is unnecessary to play a music piece on the CD 105 at the time of auto-playing and it is insignificant to set the CD priority repeat mode, the process will be terminated without executing anything.

If the decision in S1002 becomes YES in the former case, the flow advances to S1003 where the present memory address "1" is further incremented by "1" to be "2."

In step S1004, the CD absolute time data $D_{AT}$ from the top of the piece of music to be reproduced from the CD 105 in the auto-playing is read out from the memory address "2" and is transferred to the CD controller 103. Meanwhile, the instrument controller 201 gives an instruction to set the CD top to the CD controller 103. The CD controller 103 in turn controls the optical pickup 107 through the servo controller 104 to set the top position on the CD 105 corresponding to the aforementioned CD absolute time data $D_{AT}$.

In the next step S1005, the content of the memory address is incremented by "1" to be "3." Based on the CD play command $C_{PY}$ stored at the memory address "3," a CD play instruction is given to the CD controller 103. As a result, the CD player section 100 starts playing the CD 105 from the top of the piece of music whose top has been set in S1004.

In this state, the user can arbitrarily select the timing to synchronously start the auto-playing of the electronic keyboard instrument section 200 (this timing will be hereinafter simply called "play start timing") while reproducing the audio data recorded on the CD 105 by depressing the PAUSE switch 1023 (FIG. 2) after the operation of the FF switch 1024 or REW switch 1025 of the CD drive section 102.

The instrument controller 201 determines through the CD controller 103 in S1006 whether the PAUSE switch $102_3$ (FIG. 2) of the CD drive section 102 has been depressed. When the user has depressed the PAUSE switch $102_3$, the reproduction of the audio data is paused under the control of the CD controller 103.

When the use operates the A switch $202_7$ (FIG. 3) of the instrument operating section 202, the decision in the next step S1007 becomes YES. Accordingly, the play start timing specified by the user is set through the above operation.

In the subsequent step S1008, the instrument controller 201 receives the CD absolute time data $D_{AT}$ at the pause time from the CD controller 103, and holds it in the latch circuit (not particularly shown).

Every time the process of S1009 in the repetitive process sequence from S1009, to S1010, to S1011, to S1012, then back to S1009 is executed following the above operation, the memory address is incremented by "1," and every time the process of S1010 is executed, it is determined whether or not the content of the memory address is the key-ON command $C_{ON}$.

Figure 14A:
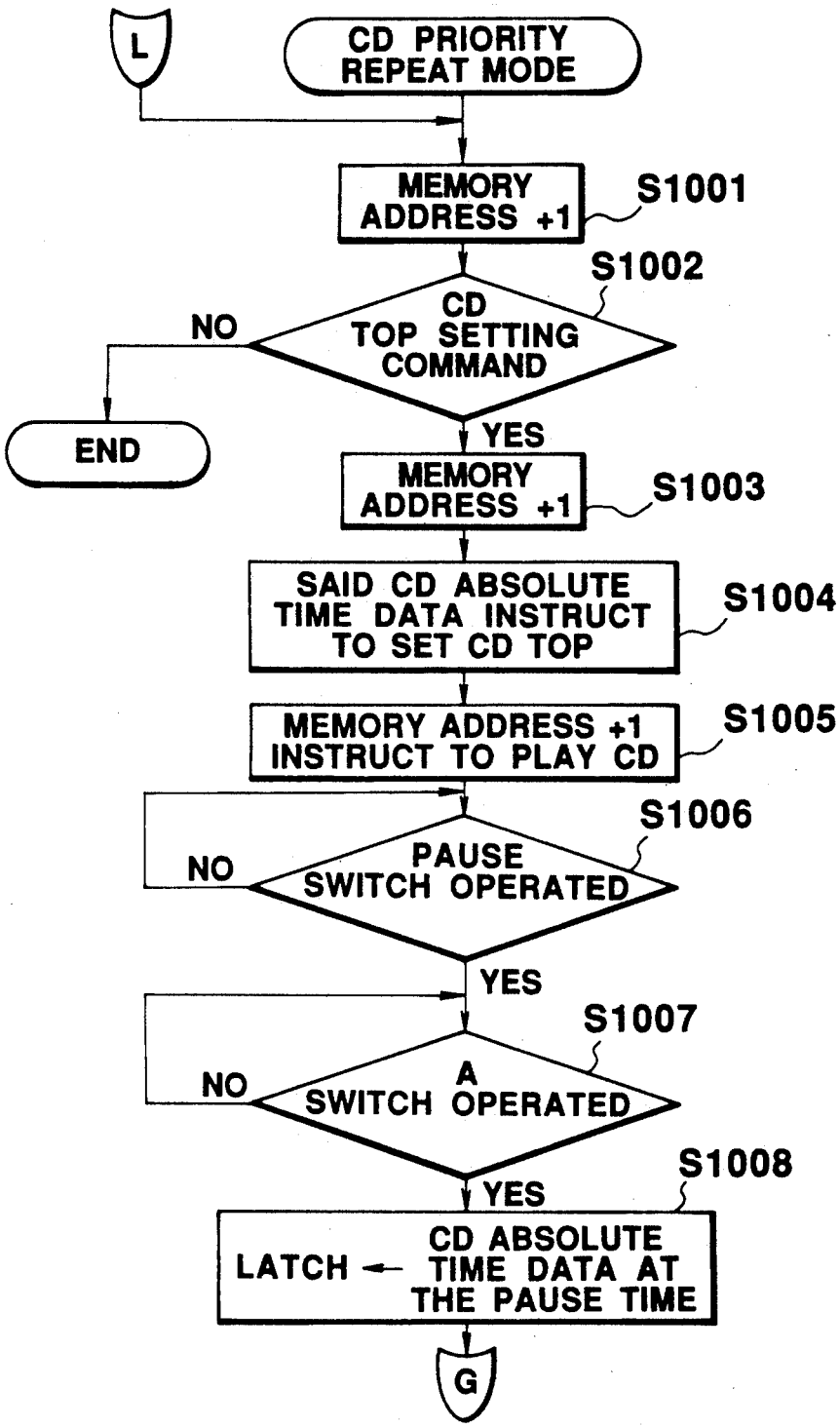
FIGS. 14A to 14F are flowcharts illustrating a control operation in CD priority repeat mode.
Figure 14B:
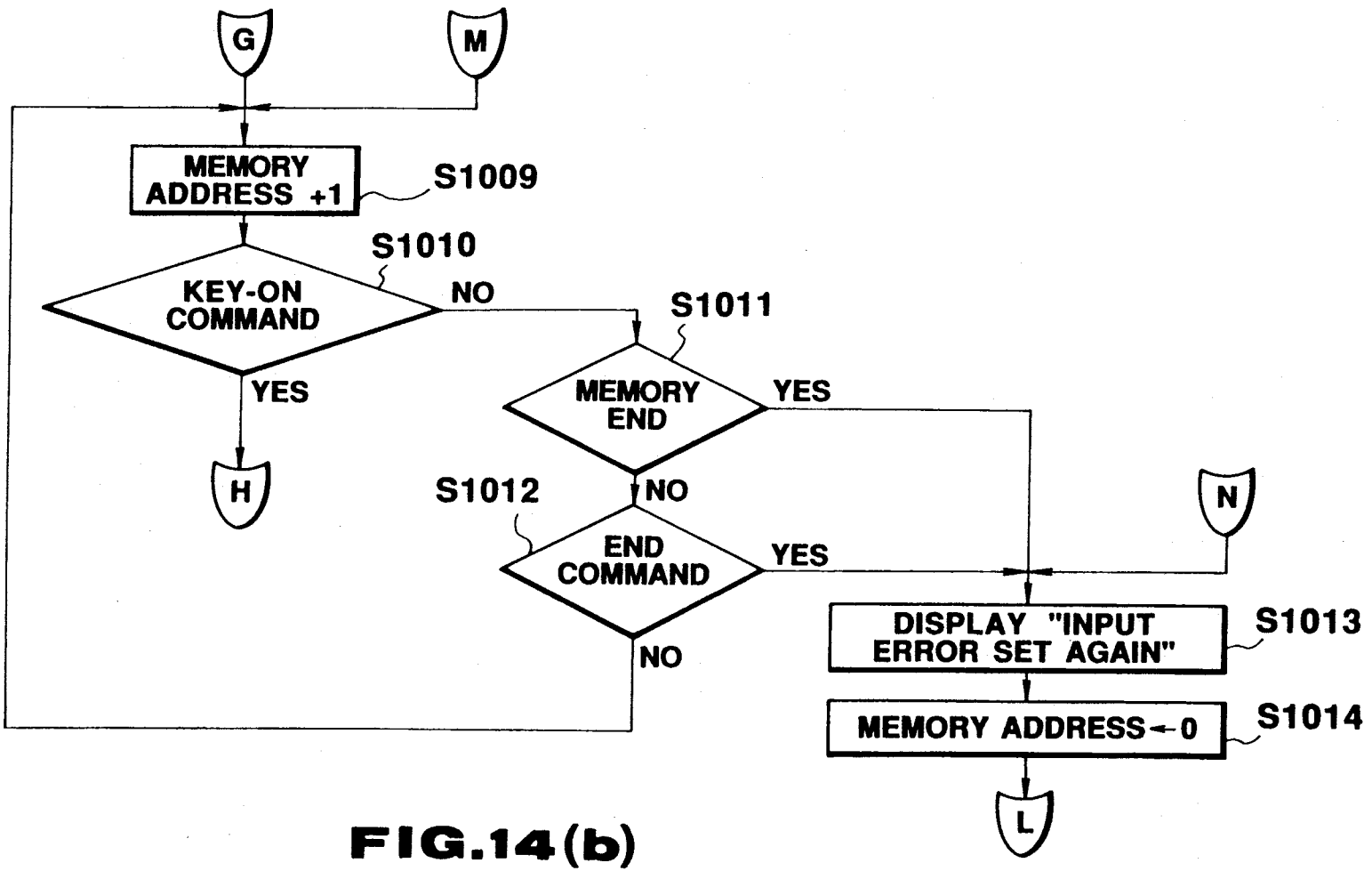
Figure 14C:
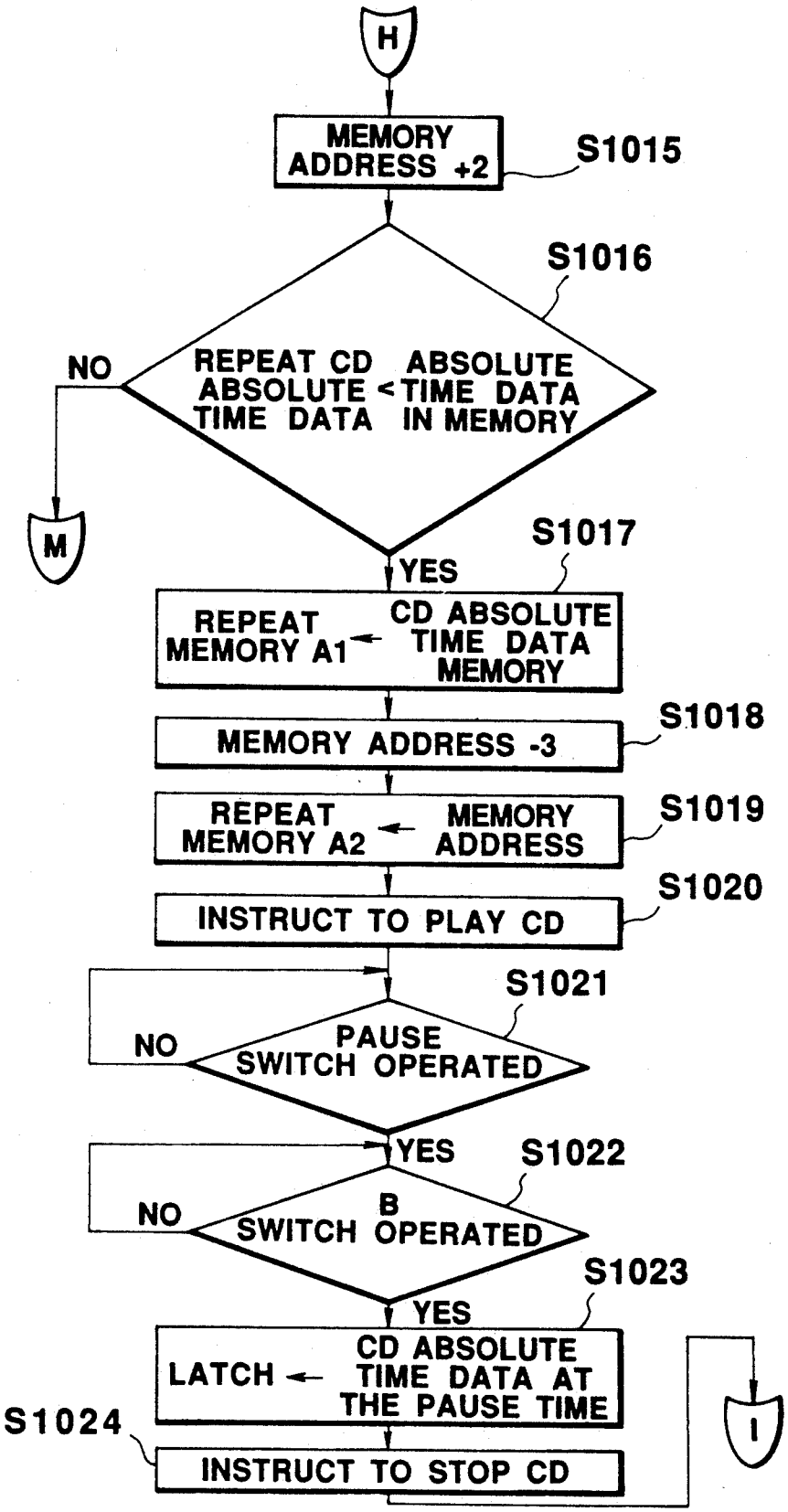
Figure 14D:
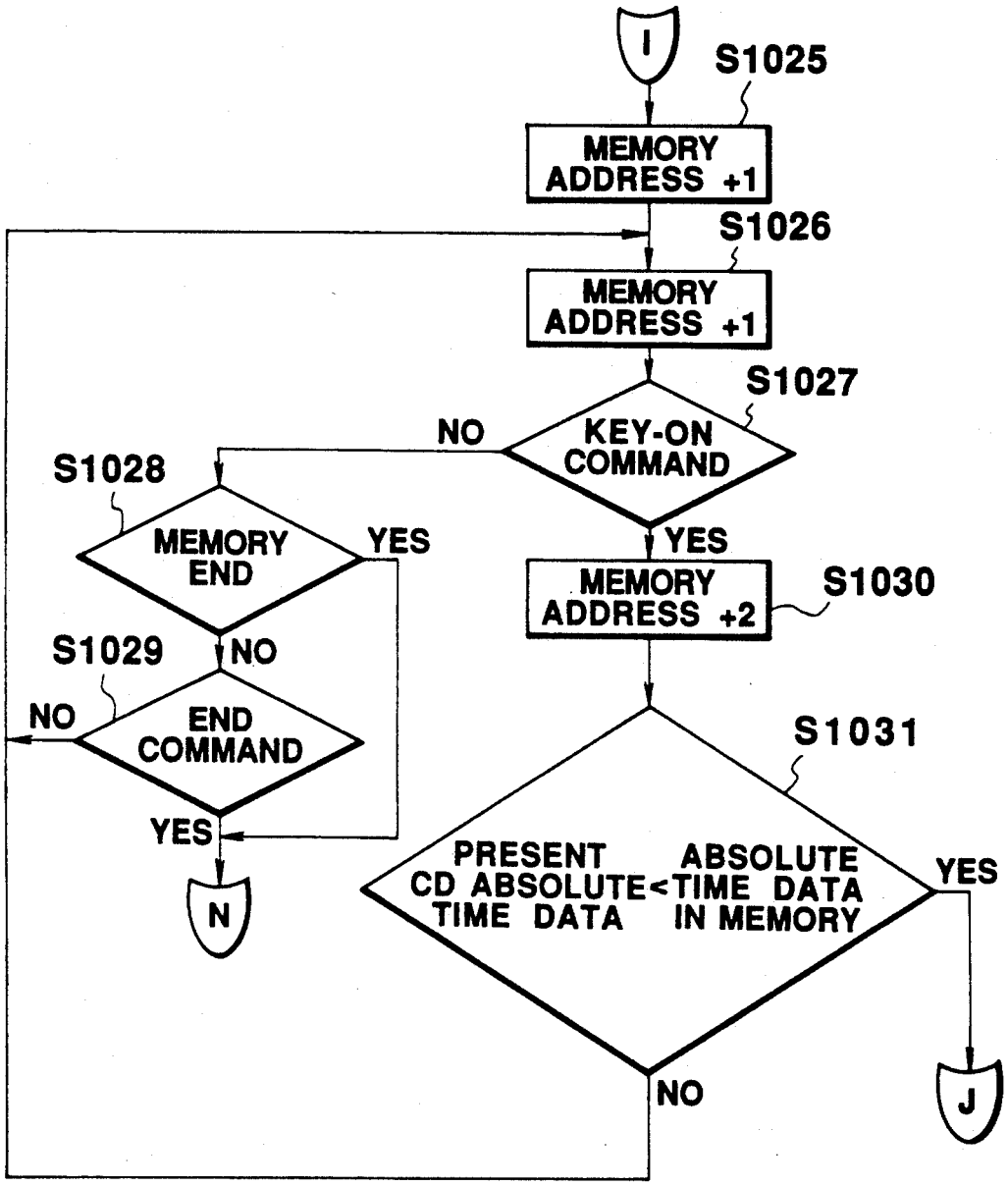
Figure 14E:
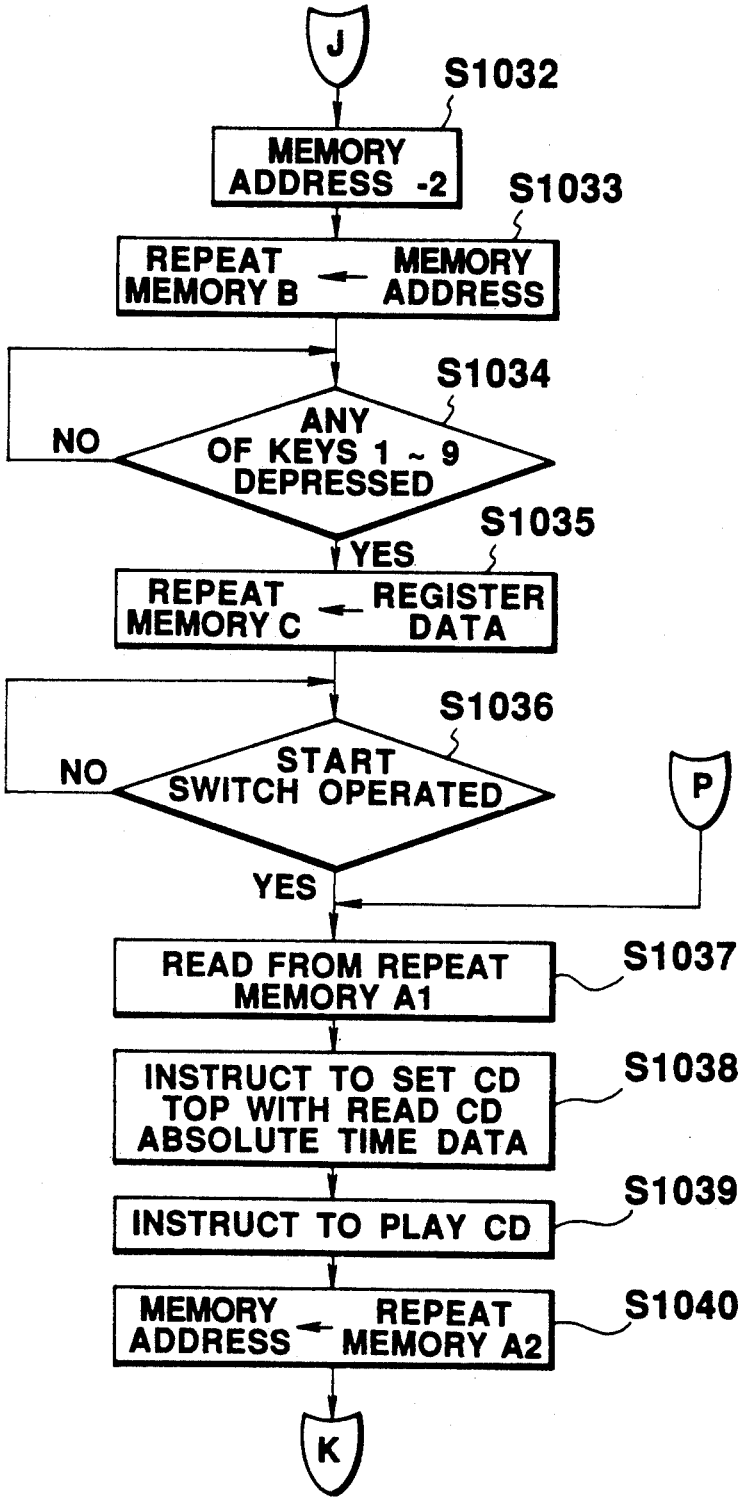

When the key-ON command $C_{ON}$ is detected in S1010 in the above repetitive process sequence, the decision in that step becomes YES and the flow advances to S1015 shown in FIG. 14C. In S1015, the memory address where the command is stored is incremented by "2." At this memory address (e.g., memory address "8" in FIG. 10) is stored the CD absolute time data $D_{AT}$ corresponding to the detected key-ON command $C_{ON}$.

In S1016, the CD absolute time data $D_{AT}$ corresponding to the detected key-ON command $C_{ON}$ is read out from that memory address and it is determined whether or not this data exceeds (or is greater than) the aforementioned, latched CD absolute time data at the pause time. If the former data does not exceed the latter, it means that the memory address in the auto-play memory 208 has not reached the position corresponding to the timing at the pause time. The flow then returns to S1009 and the process sequence of S1009 to S1012 is repeated to search for the next key-ON command $C_{ON}$ on the auto-play memory 208.

Every time the process of S1011 in the above repetitive process is executed, it is judged whether or not the memory address on the auto-play memory 208 has reached the last address (memory end), or upon every execution of the process of S1012, it is judged whether or not the end command $C_E$ has been read out from the auto-play memory 208. When the decision in S1011 or S1012 becomes YES, which means that no corresponding sequence data exists on the memory 208, the error message "Input error. Set again" is displayed in S1013, the memory address is reset to "0" in S1014, then the flow returns to S1001 to permit the user to input the play start timing again.

If the CD absolute time data $D_{AT}$ corresponding to the detected key-ON command $C_{ON}$ from the auto-play memory 208 exceeds the above-mentioned, latched CD absolute time data at the pause time in S1016, the decision in this step becomes YES and the flow advances to S1017.

In this step S1017, the detected CD absolute time data $D_{AT}$ is stored in the repeat memory A1 (not particularly shown) in the instrument controller 201.

In the subsequent step S1018, the present memory address is decremented by "3." This memory address indicates the address where the first CD absolute time data $D_{AT}$ which has exceeded the CD absolute time data at the pause time at the play start timing is stored through the process of S1015, e.g., at the address "8" in FIG. 10. Therefore, the memory address after decremented by "3" indicates one address previous to the address like the address "5" in FIG. 10 where the key-ON command $C_{ON}$ corresponding to the CD absolute time data $D_{AT}$ is stored. This process is done to provide the matching with the process of S1041 which will be described later. This relation is the same as the case of the aforementioned step S912.

The content of this memory address is stored in the repeat memory A2 in the next step S1019. Accordingly, the memory address for the play start timing is set.

Subsequently, an instruction to play a piece of music on the CD 105 is given to the CD controller 103 to reproduce the audio data again but from the paused point in S1020. The user can therefore select the timing to end the playing of a music piece recorded on the CD 105 (this timing will be hereinafter called "play end timing"), in synchronism with the auto-playing of the electronic keyboard instrument section 200, in the same manner as done in the case of selecting the play start point.

This process is realized by the processing of S1021–S1033, which is almost the same as the processing of S1006–S1019 in the case where the user specifies the play start timing.

It should be noted that an instruction to stop the playing of a music piece on the CD 105 is given to the CD controller 103 after the process of $S102_3$ corresponding to S1008 is executed. As a result, the playing of the music piece is stopped.

Before execution of the process of S1026 corresponding to S1009, the process of S1025 is executed to increment the content of the memory address by "1." That is, the content of the memory address is incremented by "2" through the processes of S1025 and S1026. Prior to the process of S1025, the content of the memory address indicates one memory address previous to where the key-ON command $C_{ON}$ at the play start timing specified by the user is stored (see S1018). Through the processes of S1025 and S1026, therefore, the content of the memory address becomes an address next to where the key-ON command $C_{ON}$ at the mentioned play start timing is stored (see the description of S1018). This prevents the same key-ON command $C_{ON}$ as the one at the play start timing from being detected in S1027. This may occur when the user instantaneously depresses the PAUSE switch $102_3$ after the playing of the music piece on the CD 105 is restarted in S1020.

Further, since it is unnecessary to hold the CD absolute time data $D_{AT}$ corresponding to the key-ON command $C_{ON}$ in the auto-play memory 208 at the play end timing, the process corresponding to S1017 is not executed after the execution of the process of S1031 corresponding to the S1016.

After the process of S1031 corresponding to S1016, the content of the present memory address is decremented by "2" in S1032. Through the process of S1030 (corresponding to S1015), the memory address indicates the address where the first CD absolute time data $D_{AT}$ which has exceeded the CD absolute time data at the pause time at the play end timing is stored. The memory address when incremented by "2" therefore becomes the address where the key-ON command $C_{ON}$ corresponding to the CD absolute time data $D_{AT}$ is stored.

After the above operation, the content of the memory address is stored in the repeat memory B (not shown) in the instrument operating section 201 in S1033. As described above, the content of the memory address indicates the address where the first CD absolute time data $D_{AT}$ which has exceeded the CD absolute time data at the pause time at the play end timing specified by the user is stored. Accordingly, the memory address at the play end timing is set.

After specifying the play start timing and play end timing, the user specifies the repeat number to repeat the auto-playing in the range in the above manner. This process is realized by the processes in S1034 and S1035 shown in FIG. 14E, and this is the same as the processes in S930 and S931 in the aforementioned sequencer priority repeat mode. Accordingly, the repeat number for the auto-playing is set in the repeat memory C (not shown) in the instrument operating section 201.

After the above sequence of operations, the user depresses the START switch $202_3$ (FIG. 3) of the instrument operating section 202 to execute the synchronized reproduction by the CD player section 100 and the autoplaying operation of the electronic keyboard instrument section 200 in synchronism with the reproduction.

In other words, when the START switch $202_3$ is depressed, the decision in S1036 becomes YES, and the content of the repeat memory A1 is read out in S1037. This content is the CD absolute time data $D_{AT}$ (see S1017) read out from the auto-play memory 208 corresponding to the play start timing.

In the subsequent step S1038, the CD absolute time data $D_{AT}$ is sent to the CD controller 103 and the CD top setting command is given to the CD controller 103 This sets the top of a music piece on the CD 105 corresponding to the aforementioned CD absolute time data $D_{AT}$ on the side of the CD player section 100.

Further, an instruction to play the music piece on the CD 105 is given to the CD controller 103 in S1039. In this case, the play start timing is synchronized with the play start timing specified by the user as described above. In this case, since the top of the music piece is set with the CD absolute time data $D_{AT}$ stored in the auto-play memory 208 in S1038, the timing is not strictly the same as the play start timing on the CD 105 specified by the user, but the difference hardly causes a different in hearing.

Then, the content of the repeat memory A2 is set at the memory address in S1040. As described above, the content indicates one memory address previous to the position of the key-ON command $C_{ON}$ in the auto-play memory 208 at the play start point specified by the user.

Figure 14F:
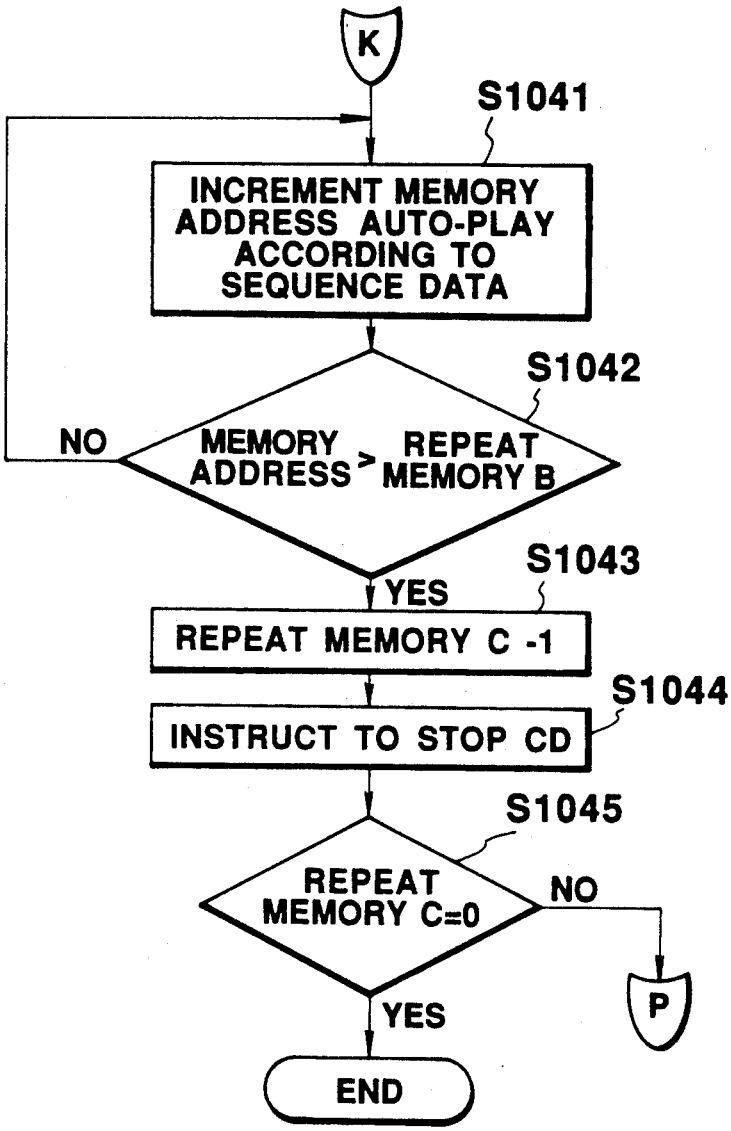

After the above operation, as in the aforementioned sequencer priority repeat mode, every time the process of S1041 is executed by the repetition of steps S1041 and S1042 shown in FIG. 14F, the memory address of the auto-play memory 208 is sequentially incremented from the memory address set in S1040, and the sequence data is read out from each memory address. The auto-playing is performed in accordance with the content of the sequence data.

As in the case of the sequence priority repeat mode, the above-described single auto-playing is terminated when the memory address of the sequence data exceeds the value of the repeat memory B and the decision in S1042 becomes YES. In other words, the content of the repeat memory B indicates the address where the key-ON command $C_{ON}$ corresponding to the first CD absolute time data $D_{AT}$ which has exceeded the CD absolute time data at the pause time at the play end timing is stored. After the commands up to this key-ON command $C_{ON}$ are executed in S1041, the single auto-playing is terminated.

Thereafter, as in the case of S948, the content of the repeat memory C is decremented by "1" in S1043 every time the single auto-playing is completed.

After the above operation, as in the process of S949, an instruction to stop the reproduction is given to the CD controller 103 in S1044, then it is determined whether or not the content of the repeat memory C becomes "0" in S1045 as per the process of S950. If this content is not "0," the decision in S1045 becomes NO and the flow returns to S1037, repeating the processing for the synchronized auto-playing. When the content of the repeat memory C becomes "0," the decision in S1045 becomes NO, terminating the process in the CD priority repeat mode.

Operation of Synchronous Adjustment

In the above-described various sequencer play modes, after the playing of a piece of music by the CD player section 100 and the auto-playing by the electronic keyboard instrument section 200 synchronously start from the point selected by the user, the CD controller 103 and instrument controller 201 independently execute the playing of the music piece of the CD 105 and the auto-playing based on the sequence data stored in the auto-play memory 208 until the auto-playing is terminated at the point specified by the user.

Figure 15:
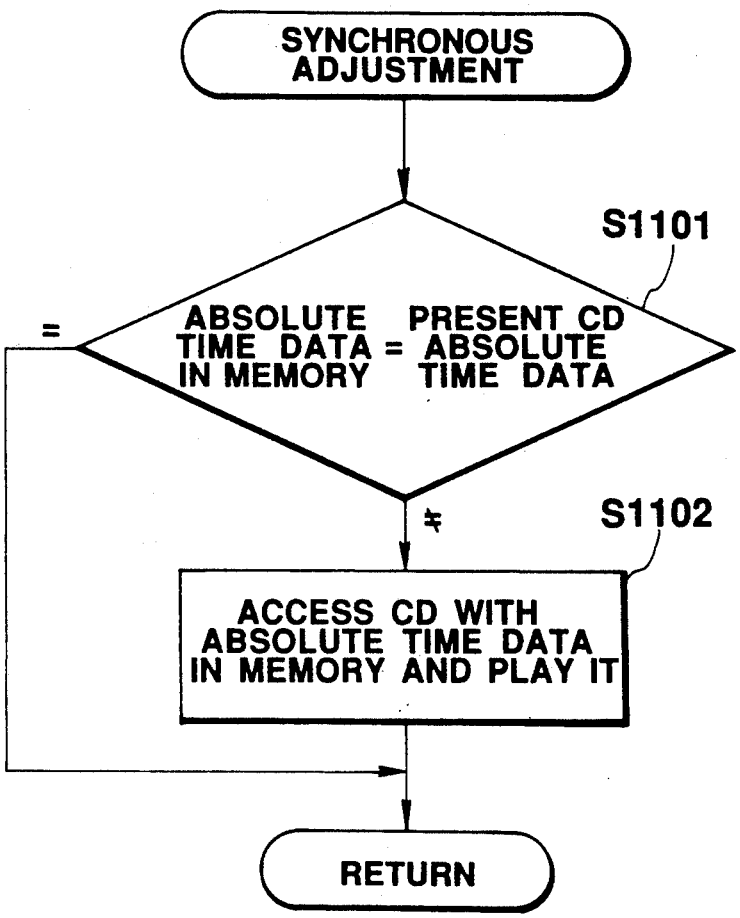
FIG. 15 is a flowchart illustrating a control operation in a synchronous adjustment process.

The arrangement may be modified so that synchronous correction is possible even during the auto-playing. FIG. 15 illustrates an operational flowchart for the synchronous adjusting process for the correction. This process is executed by the instrument controller 201.

More specifically, after starting the auto-playing in S843 shown in FIG. 12B, S946 in FIG. 13E, or S1041 in FIG. 14F, the instrument controller 201 executes the synchronous adjusting operation illustrated in FIG. 15 every time one key-ON command $C_{ON}$ is read out from the auto-play memory 208 or the key-ON command $C_{ON}$ is read out several times (five times).

Referring to FIG. 15, in S1101, the key-ON command $C_{ON}$ is read out from the auto-play memory 208 first, then the memory address is incremented by "2" and the corresponding CD absolute time data $D_{AT}$ is read out (see FIG. 10). At the same time, the instrument controller 201 receives the CD absolute time data from the CD 105 which is sequentially detected via the subcode signal processor 110 by the CD controller 103. These two CD absolute time data are then compared with each other.

When they are equal to each other, no processing will be done. When they do not coincide with each other, however, the process of S1102 will be executed. In S1102, the instrument controller 201 accesses to the CD controller 103 using the CD absolute time data $D_{AT}$ read out from the auto-play memory 208, and instructs to play a music piece at that timing.

Through the above synchronous adjusting operation, even when, for example, a scratch is present on the CD 105 and the reproduction of a music piece would jump in a midway, the auto-playing operation by the electronic keyboard instrument section 200 can always be synchronized with the operation to play the music piece by the CD player section 100.

Other Embodiment

According to the above-described embodiments, CD absolute time data $D_{AT}$ is stored in the auto-play memory 208 at the timing to store the key-ON command $C_{ON}$ in sequencer write mode. When a command, such as a program change (timbre change), is to be stored as the sequence data, however, the CD absolute time data $D_{AT}$ may be stored at the timing when this command is stored. This can permits the auto-playing to be synchronized with the CD reproduction at the timing of the program change. The CD absolute time data $D_{AT}$ may be stored at timings of various types of sequence data. Further, a CD music number and CD relative time data may be used in place of the CD absolute time data $D_{AT}$.

Further, in sequencer priority mode, it is possible to repress the UP switch $202_5$ or DOWN switch $202_6$ to jump to an arbitrary timing during the playing of a CD in synchronism with the auto-playing so that the synchronized reproduction is restarted from the jumped timing. In this case, when the UP switch $202_5$ or DOWN switch $202_6$ is depressed during the process of S843 shown in FIG. 12B, an interrupt process is performed. The auto-playing and the CD playing are temporarily stopped at that timing. Then, the processes of steps including and following S802 in FIG. 12A have only to be executed. This way can cope with the case where there is a part which the user does not want to listen and can be fast-forwarded, or where there is a part which the user wants to listen repeatedly so that this part is rewound.

The same processing is possible even in CD priority mode. In this case, when the REW switch $102_5$ or FF switch $102_4$ of the CD drive section 102 is depressed during the process of S843 in FIG. 12B, an interrupt process will be executed. At that point of time, the auto-playing and the playing of the CD are temporarily stopped. While the REW switch $102_5$ or FF switch $102_4$ is depressed, the FF/REW operation on the CD is performed as in the case of ordinary CD players. When the depression of the switch is released, the CD absolute time data at that point of time is stored in a latch circuit. Based on the latched CD absolute time data, the processes of steps including and following S832 in FIG. 12C have only to be executed.

Although the user plays in advance the keyboard $202_1$ (FIG. 3) in accordance with the playing of a piece of music of the CD 105 in sequencer write mode and writes sequence data in the auto-play memory 208, this invention is not limited to this particular type. For instance, sequence data may be stored in advance in user's bits (recording area of a CD-ROM) of subcodes on a ROM or CD, these sequence data may be transferred to the auto-play memory 208 at the time of auto-playing. The form, type or the like of the sequence data to be stored may be arbitrarily altered in accordance with instruments which perform the auto-playing.

Although the foregoing description has been given with reference to a case where the repeating of the auto-playing is done between two points set by the user in repeat mode, the repeating operation may be done within a range from the top of a music piece to an arbitrarily set point or from an arbitrarily set point to the end of the music piece. Further, it is possible to repeat a specific refrain part specified by the user after the auto-playing is carried out while fully playing a certain piece of music. Various types of repeat patterns may be set, and they may be selected by a program.

In addition, the auto-playing by the electronic keyboard instrument section 200 is executed in synchronism with the playing of a piece of music on the CD 105 by the CD player section 100. This invention is not however limited to CD players, but may be applied to any music playing apparatus as long as it can sequentially output time data in accordance with the playing of the music piece, such as a $D_{AT}$ (Digital Audio Tape Recorder). Further, this invention is not limited to the time data, but other data such as address data may be used instead as long as the timing of the data can be obtained.

Although the foregoing description of the embodiments has been given with reference to an electronic keyboard instrument as the one having an auto-play function, the invention is not restricted to this particular type of instrument. For instance, an electronic musical instrument without a keyboard, such as an electronic wind instrument or an electronic guitar, may be used as well.

Further, the instrument to perform the auto-playing is not limited to an electronic musical instrument. For instance, with a conventional acoustic musical instrument, such as a piano, in use, if a sensor is used to output play data such as pitch data or velocity data, and a plunger solenoid or the like is used to depress a key, a piano part can be auto-played in accordance with a CD having data recorded in minus-one form so that a piano concerto can be played to give the realistic feeling.

Additional advantages and modifications will readily occur to those skilled in the art. Therefore, the invention in its broader aspects is not limited to the specific details, and representative device, shown and described herein. Accordingly, various modifications may be without departing from the spirit or scope of the general inventive concept as defined by the appended claims and their equivalents.

What is claimed is:

1. An auto-playing apparatus which employs a recording medium that stored audio data and first position data representing a recording position of the audio data such that the audio data and the first position data are associated with each other, and in which the audio data and the auto-play data can be reproduced in synchronism with each other, said auto-playing apparatus comprising:

reproducing means for reproducing the audio data and the first position data from the recording medium by playing the recording medium;

storing means for storing (a) a series of auto-play data items which are to be reproduced in synchronism with the audio data recorded on the recording medium, and (b) second position data corresponding to the first position data and which represents at the same reproduction timing as that of the auto-play data, auto-playing means, coupled to the storing means, for reading the auto-play data from the storing means and for sequentially generating corresponding tone signals to execute auto-playing;

setting means for setting conditions under which synchronous reproduction of the audio data and auto-play data is performed, said setting means including means for selecting a reproduction start point, and means for determining a second position data corresponding to the selected reproduction start point from among the second position data stored in the storing means;

retrieving means, coupled to the reproducing means, for detecting the second position data stored in the storing means in accordance with the setting of the setting means and for retrieving the first position data corresponding to the detected second position data from among the first position data stored in the recording medium; and control means, coupled to the setting means, to the auto-playing means, to the retrieving means, and to the reproducing means, for performing control to start auto-playing from the position which the setting means selects as the reproduction start point, and to play the recording medium from the audio data corresponding to the first position data retrieved by the retrieving means, and wherein when the reproduction start point is an intermediate position, intermediate a beginning and an end of the audio data, auto-play starts without delay.

2. An auto-playing apparatus according to claim 1, wherein said second position data is stored in correspondence to one of: a single auto-play data item, auto-play data items within a predetermined time period, and auto-play data items representative of a predetermined command.

3. An auto-playing apparatus according to claim 1, wherein:

said setting means further selects one auto-play data item used as a reproduction end point from among the auto-play data items stored in the storing means; and said control means performs control such that auto-playing is started from the auto-play data item which the setting means selects as the reproduction start point and such that the recording medium is played from the audio data corresponding to the first position data retrieved by the retrieving means, in synchronism with the start of the auto-playing, and further performs control such that the auto-playing and the play of the recording medium are simultaneously stopped when the auto-playing based on the auto-play data item selected by the setting means as the reproduction end point has just been performed.

4. An auto-playing apparatus according to claim 3, wherein:

said setting means further sets the number of times the auto-playing data between the reproduction start point and the reproduction end point is to be repeated; and said control means performs control such that auto-playing is started from the auto-play data item which the setting means selects as the reproduction start point and such that the recording medium is played from the audio data corresponding to the first position data retrieved by the retrieving means, in synchronism with the start of the auto-playing, and further performs control such that the auto-playing and the play of the recording medium are simultaneously stopped when the auto-playing based on the auto-play data item selected by the setting means as the reproduction end point has just been performed and such that the auto-playing is repeated the number of times set by the setting means.

5. An auto-playing apparatus according to claim 1, wherein the auto-play data items stored in the storing means includes sounding start data indicating the start of the sounding of a tone, and data representing a tone pitch, said second position data being stored in correspondence to the sounding start data.

6. An auto-playing apparatus according to claim 1, further comprising:

input means for sequentially inputting auto-play data items in accordance with audio data being reproduced, when the recording medium is being played by the reproducing means; and detecting means, coupled to both the reproducing means and to the input means, for detecting the first position data corresponding to the audio data which is being reproduced when the auto-play data is input, said first position data being detected in correspondence to one of: auto-play data items inputted at one time, auto-play data items within a predetermined time period, and auto-play data items representative of a predetermined command;

said storing means being coupled to both the input means and to the detection means and sequentially storing the auto-play data items input by the input means, said storing means further storing second position data which is associated with the first position data detected by the detecting means, said second position data being stored in correspondence to one of: one auto-play data item input by the input means, auto-play data items within a predetermined time period, and auto-play data items representative of a predetermined command.

7. An auto-playing apparatus according to claim 1, wherein said control means sequentially compares the second position data corresponding to the auto-play data which is presently reproduced with the first position data corresponding to the audio data which is presently reproduced, while the recording medium is being played and auto-playing is being performed, and, upon detection of non-coincidence, controls the reproduction timing of the recording medium so as to allow the second position data to correspond to the first position data.

8. An auto-playing apparatus which employs a recording medium that stored audio data and first position data representing a recording position of the audio data such that the audio data and the first position data are associated with each other, and in which the audio data and the auto-play data can be reproduced in synchronism with each other, said auto-playing apparatus comprising:

reproducing means for reproducing the audio data and the first position data from the recording medium by playing the recording medium;

storing means for storing (a) a series of auto-play data items which are to be reproduced in synchronism with the audio data recorded on the recording medium, and (b) second position data which is associated with the first position data and represents at the same reproduction timing as that of the auto-play data;

auto-playing means, coupled to the storing means, for reading the auto-play data from the storing means and for sequentially generating corresponding tone signals to execute auto-playing;

setting means for setting conditions under which synchronous reproduction of the audio data and auto-play data is performed, said setting means including means for specifying a reproduction start point by use of the audio data recorded on the recording medium;

retrieving means, coupled to the reproducing means, for detecting the first position data which is recorded on the recording medium in correspondence to the reproduction start point specified by the setting means, and for retrieving the second position data corresponding to the detected first position data from among the second position data stored in the storing means; and control means, coupled to the setting means, to the auto-playing means, to the retrieving means, and to the reproducing means, for performing control to start the play of the recording medium from the reproduction start point specified by the setting means and to start the auto-playing from the auto-play data corresponding to the second position data retrieved by the retrieving means, and wherein when the reproduction start point is an intermediate position, intermediate a beginning and an end of the audio data, auto-play starts without delay.

9. An auto-playing apparatus according to claim 8, wherein said second position data is stored in correspondence to one of: a single auto-play data item, auto-play data items within a predetermined time period, and auto-play data representative of a predetermined command.

10. An auto-playing apparatus according to claim 7, wherein:

said setting means further specifies a reproduction end point by use of the audio data recorded on the recording medium; and said control means performs control such that the recording medium is played from the reproduction start point specified by the setting means and such that the auto-playing is started from the auto-play data item corresponding to the second position data retrieved by the retrieving means, and further performs control such that the play of the recording medium and the auto-playing are simultaneously stopped when the audio data item corresponding to the reproduction end point specified by the setting means has just been reproduced.

11. An auto-playing apparatus according to claim 10, wherein:

said setting means further sets the number of times the play between the reproduction start point and the reproduction end point is to be repeated; and said control means performs control such that the recording medium is played from the reproduction start point specified by the setting means and such that the auto-playing is started from the auto-play data item corresponding to the second position data retrieved by the retrieving means, and further performs control such that the play of the recording medium and the auto-playing are simultaneously stopped when the audio data item corresponding to the reproduction end point specified by the setting means has just been reproduced and such that the play of the recording medium is repeated the number of times set by the setting means.

12. An auto-playing apparatus according to claim 8, wherein the auto-play data items stored in the storing means includes sounding start data indicating the start of the sounding of a tone, and data representing a tone height, said second position data being stored in correspondence to the sounding start data.

13. An auto-playing apparatus according to claim 10, further comprising:

input means for sequentially inputting auto-play data items in accordance with audio data being reproduced, when the recording medium is being played by the reproducing means; and detecting means, coupled to both the reproducing means and to the input means, for detecting the first position data corresponding to the audio data which is being reproduced when the auto-play data is input, said first position data being detected in correspondence to one of: auto-play data items inputted at one time, auto-play data items within a predetermined time period, and auto-play data items representative of a predetermined command;

said storing means being coupled to both the input means and to the detection means and sequentially storing the auto-play data items input by the input means, said storing means further storing second position data which is associated with the first position data detected by the detecting means, said second position data being stored in correspondence to one of: one auto-play data item input by the input means, auto-play data items within a predetermined time period, and auto-play data items representative of a predetermined command.

14. An auto-playing apparatus according to claim 8, wherein said control means sequentially compares the second position data corresponding to the auto-play data which is presently reproduced with the first position data corresponding to the audio data which is presently reproduced, while the recording medium is being played and auto-playing is being performed, and, upon detection of non-coincidence, controls the reproduction timing of the recording medium so as to allow the second position data to correspond to the first position data.

15. A reproduction method for reproducing audio data and auto-play data in synchronism with each other, which method employs:

a recording medium that stores the audio data and first position data representing a recording position of the audio data such that the audio data and the first position data are associated with each other; and storing means for storing (a) a series of auto-play data items which are to be reproduced in synchronism with the audio data recorded on the recording medium, and (b) second position data which is associated with the first position data and represents a recording position of the audio data that is to be reproduced at the same reproduction timing as that of the auto-play data;

said reproduction method comprising:

a first step of selecting one auto-play data item used as a reproduction start point from among the auto-play data items stored in the storing means;

a second step of detecting the second position data stored in the storing means in accordance with the auto-play data item which is selected as the reproduction start point in said first step;

a third step of retrieving the first position data corresponding to the second position data detected in said second step, from among the first position data stored in the recording medium; and a fourth step of performing control such that auto-playing is started from the auto-play data item which is selected in said first step as the reproduction start point, and such that the recording medium is played from the audio data corresponding to the first position data retrieved in said third step.

16. A reproduction method according to claim 15, wherein said second position data is stored in correspondence to one a single auto-play data item, auto-play data items within a predetermined time period, and auto-play data items representative of a predetermined command.

17. A reproduction method according to claim 15, wherein:

said first step includes a substep of selecting one auto-play data item used as a reproduction end point from among the auto-play data items stored in the storing means; and said fourth step includes a substep of performing control such that auto-playing is started from the auto-play data item which is selected as the reproduction start point in said first step and such that the recording medium is played from the audio data corresponding to the first position data retrieved in said third step, in synchronism with the start of the auto-playing, and further performing control such that the auto-playing and the play of the recording medium are simultaneously stopped when the auto-playing based on the auto-play data item which is selected as the reproduction end point in said first step has just been performed.

18. A reproduction method according to claim 17, wherein:

said first step includes a substep of further setting the number of times the auto-playing between the reproduction start point and the reproduction end point is to be repeated; and said fourth step includes a substep of performing control such that auto-playing is started from the auto-play data item which is selected as the reproduction start point in said first step and such that the recording medium is played from the audio data corresponding to the first position data retrieved in said third step, in synchronism with the start of the auto-playing, and further performing control such that the auto-playing and the play of the recording medium are simultaneously stopped when the auto-playing based on the auto-play data item which is selected as the reproduction end point in said first step has just been performed and such that the auto-playing is repeated the number of times set by the setting means.

19. A reproduction method for reproducing audio data and auto-play data in synchronism with each other, in a system which includes:

a recording medium that stores the audio data and first position data representing a recording position of the audio data such that the audio data and the first position data are associated with each other; and storing means for storing (a) a series of auto-play data items which are to be reproduced in synchronism with the audio data recorded on the recording medium, and (b) second position data which is associated with the first position data and represents a recording position of the audio data that is to be reproduced at the same reproduction timing as that of the auto-play data;

said reproduction method comprising:

a first step of specifying a reproduction start point by use of the auto-play data items stored in the storing means;

a second step of detecting the first position data stored in the storing means in accordance with the reproduction start point specified in said first step;

a third step of retrieving the second position data corresponding to the first position data detected in said second step, from among the second position data stored in the storing means; and a fourth step of performing control such that the recording medium is played from the reproduction start point specified in said first step and such that auto-playing is started from the auto-play data item corresponding to the second position data retrieved in said third step.

20. A reproduction method according to claim 19, comprising storing said second position data in correspondence to one of: a single auto-play data item, auto-play data items within a predetermined time period, and auto-play data items representative of a predetermined command.

21. A reproduction method according to claim 19, wherein:

said third step includes a substep of sequentially comparing the first position data detected in said second step with the second position data stored in the storing means and retrieving a minimum-value second position data item from among second position data items whose values are larger than those of the first position data; and said fourth step includes a substep of playing the recording medium from the reproduction start point specified in said first step, comparing values of the first position data reproduced from the recording medium with those of the second position data retrieved in said third step, and, upon detection of coincidence in value, executing auto-playing from the auto-play data corresponding to the second position data retrieved in said third step.

22. A reproduction method according to claim 21, wherein:

said first step includes a substep of specifying a reproduction start point and a reproduction end point by use of the audio data recorded on the recording medium;

said fourth step includes a substep of performing control such that the recording medium is played from the reproduction start point specified in said first step and such that auto-playing is started from the auto-play data item corresponding to the second position data retrieved in said third step, and further performing control such that the auto-playing and the play of the recording medium are simultaneously stopped when the reproduction of the audio data item corresponding to the reproduction end point specified in said first step has just been performed.

23. A reproduction method according to claim 22, wherein:

said first step includes a substep of further setting the number of times the auto-playing between the reproduction start point and the reproduction end point is to be repeated; and said fourth step includes a substep of performing control such that the auto-playing is started from the reproduction start point specified in said first step and such that the recording medium is played from the audio data corresponding to the first position data retrieved in said third step, and further performing control such that the auto-playing and the play of the recording medium are simultaneously stopped when the audio data corresponding to the reproduction end point specified in said first step has just been reproduced and such that the auto-playing is repeated the number of times set in said first step.

24. A reproduction method for reproducing audio data and auto-play data in synchronism with each other, in a system which includes:

a recording medium that stores the audio data and first position data representing a recording position of the audio data such that the audio data and the first position data are associated with each other; and storing means for storing (a) a series of auto-play data items which are to be reproduced in synchronism with the audio data recorded on the recording medium, and (b) second position data which is associated with the first position data and represents a recording position of the audio data that is to be reproduced at the same reproduction timing as that of the auto-play data, said second position data being stored in correspondence to one a single auto-play data item, auto-play data items within a predetermined period, and auto-play data items representative of a predetermined command;

said reproduction method comprising:

a first step of sequentially inputting auto-play data items in accordance with audio data being reproduced, when the recording medium is being played;

a second step of detecting the first position data corresponding to the audio data which is being reproduced when the auto-play data is input, said first position data being detected in correspondence to one of: auto-play data items inputted at one time, auto-play data items within a predetermined time period, and auto-play data items representative of a predetermined command;

a third step of causing the storing means to sequentially store the auto-play data items input in said first step and to store second position data which is associated with the first position data detected in said second step, said second position data being stored in correspondence to one of: one auto-play data item input by the input means, auto-play data items within a predetermined time period, and auto-play data items representative of a predetermined command;

a fourth step of selecting a reproduction start point from among the auto-play data items stored in the storing means;

a fifth step of detecting the second position data stored in the storing means in accordance with the selected reproduction start point selected in said fourth step;

a sixth step of retrieving the first position data corresponding to the second position data detected in said second step, from among the first position data recorded on the recording medium; and a seventh step of performing control such that the auto-playing is started from the auto-play data item which is selected as the reproduction start point in said fourth step and such that the recording medium is played from the audio data corresponding to the first position data retrieved in said third step.

25. A reproduction method according to claim 24, wherein:

said fourth step includes a substep of selecting auto-play data items used as a reproduction start point and a reproduction end point, respectively, from among the auto-play data items stored in the storing means; and said seventh step includes a substep of performing control such that auto-playing is started from the auto-play data item which is selected as the reproduction start point in said fourth step and such that the recording medium is played from the audio data corresponding to the first position data retrieved in said sixth step, in synchronism with the start of the auto-playing and the play of the recording medium are simultaneously stopped when the auto-playing based on the auto-play data item which is selected as the reproduction end point in said fourth step has just been performed.

26. A reproduction method according to claim 25, wherein:

said fourth step includes a substep of further setting the number of times the auto-playing between the reproduction start point and the reproduction end point is to be repeated; and said seventh step includes a substep of performing control such that auto-playing is started from the auto-play data item which is selected as the reproduction start point in said fourth step and such that the recording medium is played from the audio data corresponding to the first position data retrieved in said sixth step, in synchronism with the start of the auto-playing, and further performing control such that the auto-playing and the play of the recording medium are simultaneously stopped when the auto-playing based on the auto-play data item which is selected as the reproduction end point in said fourth step has just been performed and such that the auto-playing is repeated the number of times set by the second means.

27. A reproduction method for reproducing audio data and auto-play data in synchronism with each other in a system which includes:

a recording medium that stores the audio data and first position data representing a recording position of the audio data such that the audio data and the first position data are associated with each other; and storing means for storing (a) a series of auto-play data items which are to be reproduced in synchronism with the audio data recorded on the recording medium, and (b) second position data which is associated with the first position data and represents a recording position of the audio data that is to be reproduced at the same reproduction timing as that of the auto-play data, said second position data being stored in correspondence to one of: a single auto-play data item, auto-play data items within a predetermined period, and auto-play data items representative of a predetermined command;

said reproduction method comprising:

a first step of sequentially inputting auto-play data items in accordance with audio data being reproduced, when the recording medium is being played;

a second step of detecting the first position data corresponding to the audio data which is being reproduced when the auto-play data is input, said first position data being detected in correspondence to one of: auto-play data items inputted in said first step, auto-play data items within a predetermined time period, and auto-play data items representative of a predetermined command;

a third step of causing the storing means to sequentially store the auto-play data items input in said first step and to store second position data which is associated with the first position data detected in said second step, said second position data being stored in correspondence to one of: one auto-play data item input by the input means, auto-play data items within a predetermined time period, and auto-play data items representative of a predetermined command;

a fourth step of selecting a reproduction start point by use of the audio data recorded on the recording medium;

a fifth step of detecting the first position data recorded on the recording medium in accordance with the reproduction start point specified in said fourth step;

a sixth step of retrieving the second position data corresponding to the detected first position data, from among the second position data stored in the storing means; and a seventh step of performing control such that the recording medium is played from the reproduction start point specified in said fourth step and such that the auto-playing is started from the auto-play data item corresponding to the second position data retrieved in said sixth step.

28. A reproduction method according to claim 27, wherein:

said sixth step includes a substep of sequentially comparing the first position data detected in said fifth step with the second position data stored in the storing means and retrieving a minimum-value second position data item from among second position data items whose values are larger than those of the first position data; and said seventh step includes a substep of playing the recording medium from the reproduction start point specified in said fourth step, comparing values of the first position data reproduced from the recording medium with those of the second position data retrieved in said sixth step, and, upon detection of coincidence in value, executing auto-playing from the auto-play data corresponding to the second position data retrieved in said sixth step.

29. A reproduction method according to claim 27, wherein:

said fourth step includes a substep of specifying a reproduction start point and a reproduction end point by use of the audio data recorded on the recording medium; and said seventh step includes a substep of performing control such that recording medium is played from the reproduction start point specified in said fourth step and such that auto-playing is started from the auto-play data item corresponding to the second position data retrieved in said sixth step, and further performing control such that the play of the recording medium and the auto-playing are simultaneously stopped when the audio data corresponding to the reproduction end point specified in said fourth step has just been reproduced.

30. A reproduction method according to claim 29, wherein:

said fourth step includes a substep of further setting the number of times the auto-playing between the reproduction start point and the reproduction end point is to be repeated; and said seventh step includes a substep of performing control such that the auto-playing is started from the reproduction start point specified in said first step and such that the recording medium is played from the audio data corresponding to the first position data retrieved in said sixth step, and further performing control such that the auto-playing and the play of the recording medium are simultaneously stopped when the audio data corresponding to the reproduction end point specified in said fourth step has just been reproduced and such that the auto-playing is repeated the number of times set in said fourth step.

* * * * *